US009648667B2

(12) United States Patent
Moon et al.

(10) Patent No.: US 9,648,667 B2
(45) Date of Patent: May 9, 2017

(54) PROGRAMMABLE INDUCTION COOKING SYSTEM AND METHOD

(71) Applicant: NuWave, LLC, Libertyville, IL (US)

(72) Inventors: Jung S. Moon, Long Grove, IL (US); Byung G. Choi, Lake Villa, IL (US); Jennifer E. Dawes, Grayslake, IL (US); Mikale K. Kwon, Hoffman Estates, IL (US); Cathy Rosch, Racine, WI (US); Terry Puerzer, Mundelien, IL (US); Eunjung Huh, Vernon Hills, IL (US); Teng Jin Lian, Guangdong (CN); Kim Jong Rok, Seoul (KR); Zeng Qing Ping, Guangdong (CN)

(73) Assignee: NuWave, LLC, Libertyville, IL (US)

( * ) Notice: Subject to any disclaimer, the term of this patent is extended or adjusted under 35 U.S.C. 154(b) by 0 days.

(21) Appl. No.: 14/936,885

(22) Filed: Nov. 10, 2015

(65) Prior Publication Data

US 2016/0174298 A1 Jun. 16, 2016

Related U.S. Application Data

(63) Continuation of application No. 13/277,212, filed on Oct. 19, 2011, now Pat. No. 9,226,343, which is a continuation-in-part of application No. 12/506,628, filed on Jul. 21, 2009, now Pat. No. 8,835,810, which is a continuation-in-part of application No. 11/987,487, filed on Nov. 30, 2007, now Pat. No. 7,964,824.

(60) Provisional application No. 61/406,111, filed on Oct. 23, 2010, provisional application No. 61/470,493, filed on Apr. 1, 2011.

(51) Int. Cl.

| | |
|---|---|
| ***H05B 1/02*** | (2006.01) |
| ***H05B 6/06*** | (2006.01) |
| ***H05B 6/12*** | (2006.01) |

(52) U.S. Cl.

CPC ..... *H05B 6/062* (2013.01); *H05B 6/1209* (2013.01)

(58) Field of Classification Search

CPC ..... H05B 6/062; H05B 6/129; H05B 6/1209; H05B 6/065; H05B 1/02

USPC ..... 219/620, 627, 667, 720, 622

See application file for complete search history.

(56) References Cited

U.S. PATENT DOCUMENTS

| | | | | | |
|---|---|---|---|---|---|
| 4,511,781 | A * | 4/1985 | Tucker | H05B 6/062 | 219/506 |
| 4,536,631 | A * | 8/1985 | Tazima | H05B 6/062 | 219/625 |
| 5,486,683 | A * | 1/1996 | Shimizu | C08G 63/605 | 219/622 |
| 5,648,008 | A * | 7/1997 | Barritt | H05B 6/062 | 219/626 |
| 6,201,217 | B1 * | 3/2001 | Moon | A47J 37/0623 | 126/21 A |
| 6,805,312 | B2 * | 10/2004 | Capp | A47J 27/004 | 241/199.12 |
| 6,953,919 | B2 * | 10/2005 | Clothier | H05B 6/062 | 219/494 |

(Continued)

*Primary Examiner* — Mark Paschall

(74) *Attorney, Agent, or Firm* — Bishop Diehl & Lee, Ltd.

(57) ABSTRACT

A system and method for induction cooking using an induction cooking unit, an interface adapted to receive, store, and execute a plurality of instructions of a multistage programmable recipe using the induction cooking unit, a power supply, a controller coupled to said power supply, said interface, and said induction cooking unit.

8 Claims, 30 Drawing Sheets

(56) References Cited

U.S. PATENT DOCUMENTS

| | | | | |
|---|---|---|---|---|
| 7,355,150 | B2 * | 4/2008 | Baarman | H05B 6/062 219/506 |
| 7,786,414 | B2 * | 8/2010 | Schilling | H05B 6/1263 126/299 D |
| 8,878,108 | B2 * | 11/2014 | Kitaizumi | H05B 6/1245 126/220 |
| 2003/0173352 | A1 * | 9/2003 | Patterson | A47J 27/62 219/494 |
| 2005/0258168 | A1 * | 11/2005 | Fuchs | H05B 6/062 219/627 |

* cited by examiner

182

184

THE PRECISION INDUCTION COOKTOP

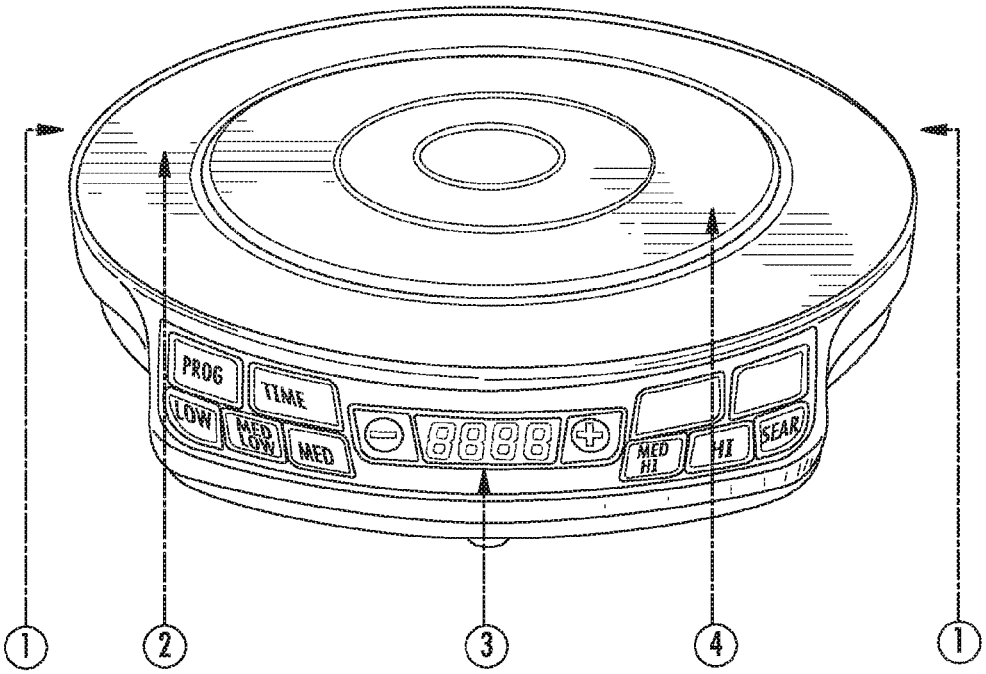

1 VENTILATION: Air vents are located on the back of the product to allow any heat generated by the heating element to escape. This allows it not to be transferred to the cooking surface and keeps the induction cooker performing efficiently.

2 TOP SURFACE: The heat resistant glass surface is easy to clean. Surface over the magnetic heating surface stays cool to the touch.

3 CONTROL PANEL WITH LCD DISPLAY: Light up, easy to read display.

4 HEATING SOURCE: An electro-magnetic coil located below the glass transfers heating power directly to your induction compatible pot, so any exposed surface remains cool to the touch.

FIG. 1J

186

DIRECTIONS FOR THE DISPLAY PANEL

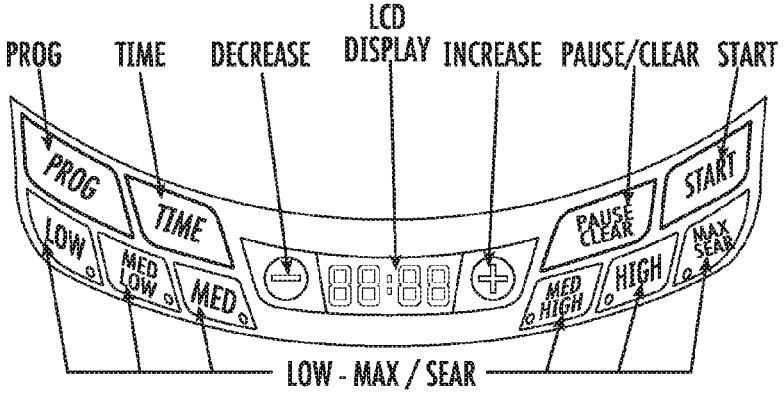

188

| PRESS BUTTON | RANGE TEMPERATURE / PANEL DISPLAY | | | EXAMPLES |
|---|---|---|---|---|
| LOW | 100°F (37°C) | / | 100F | WARM |
| MED LOW | 175°F (79°C) | / | 175F | SIMMER |
| MED | 275°F (135°C) | / | 275F | STEAM |
| MED HIGH | 375°F (191°C) | / | 375F | STIR/DEEP FRY |
| HIGH | 425°F (218°C) | / | 425F | BOIL/SAUTE |
| MAX/SEAR | MAXIMUM TEMP. | / | SEAR | SEAR |

190

| DISPLAY | PROBLEM | SOLUTION |
|---|---|---|
| E1 | POT IS NOT SECURE | MAKE SURE COOKTOP IS ON A FLAT SURFACE AND POT/PAN IS MAGNETIC |
| E2 | IGBT CONNECTION | MALFUNCTION INSIDE UNIT. CONTACT CUSTOMER SERVICE. |
| E3 | TOO LOW OF VOLTAGE | MINIMUM IS 85 VOLTS. |
| E4 | TOO HIGH OF VOLTAGE | MAXIMUM IS 144 VOLTS. |
| E5 | NTC SHORT CIRCUIT | MALFUNCTION INSIDE UNIT. CONTACT CUSTOMER SERVICE. |
| E6 | NTC OPEN CIRCUIT | MALFUNCTION INSIDE UNIT. CONTACT CUSTOMER SERVICE. |
| E7 | IGBT OVERHEATING OR AIR VENTILATION IS OBSTRUCTED | IF IGBT TEMPERATURE EXCEEDS 230 F°, ANY OPERATION WILL BE STOPPED AND BEEPING WILL OCCUR. PRESS "PAUSE / CLEAR" TWICE WAIT FOR THE UNIT TO COOL. |
| E8 | OVERHEATING | IF UNIT EXCEEDS 20° HIGHER THAN SEAR, UNIT WILL TURN OFF |
| FULL | | DURING PROGRAM MODE, WHEN THE TOTAL TIMING REACHES TO 99:99 LIMIT, NO MORE STAGES CAN BE ENTERED. |

FIG. 1K

1104
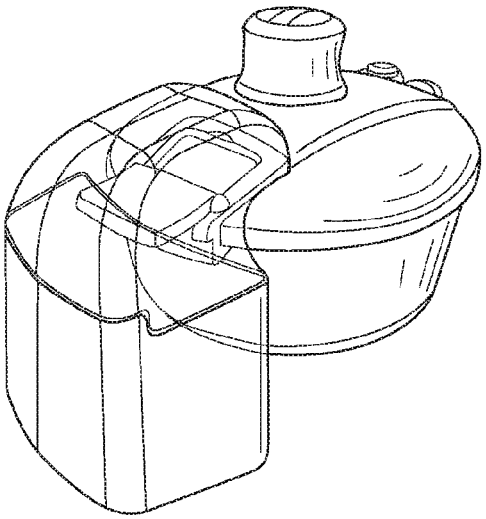
FIG. 11A3
1102
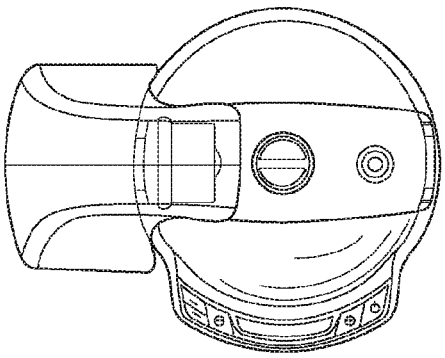
FIG. 11A2
1100
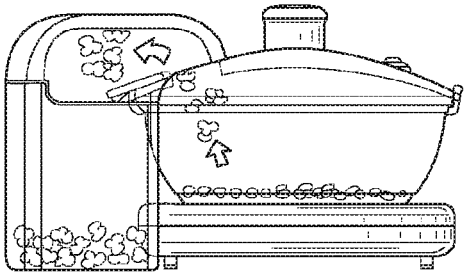
FIG. 11A1
1120
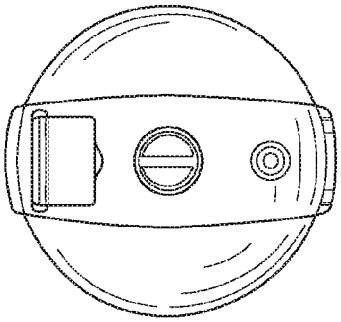
FIG. 11B2
1110
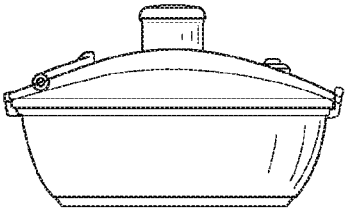
FIG. 11B1

PROGRAMMABLE INDUCTION COOKING SYSTEM AND METHOD

RELATED APPLICATIONS

The present application is a continuation of U.S. patent application Ser. No. 13/277,212 to Moon et al., filed Oct. 19, 2011 and titled "Apparatus, System, Method And Computer Program Product For Precise Multistage Programmable Induction Cooktop" now U.S. Pat. No. 9,226,343, issued Dec. 29, 2015, which is a continuation-in-part of U.S. patent application Ser. No. 12/506,628, titled "System and Method for a Programmable Counter-top Electric Dehydrator," to Moon, et al., filed Jul. 21, 2009, which is a continuation-in-part of U.S. patent application Ser. No. 11/987,487, titled "System, Method and Computer Program Product for Programmable Counter-top Electric Oven," to Moon, et al., filed Nov. 30, 2007, now U.S. Pat. No. 7,964,824. Further, the present application also claims the filing priority of U.S. Provisional Application No. 61/406,111, titled "Induction Cooktop Apparatus, System, Method And Computer Program Product" to Moon, et al., filed Oct. 23, 2010, and U.S. Provisional Application No. 61/470,493, titled "Cast Iron And Fondue Accessories For Induction Cooktop Apparatus, System, Method And Computer Program Product" to Moon, et al., filed Apr. 1, 2011. The complete disclosure of each of the above-mentioned patent applications, issued patents, and provisional applications is hereby incorporated by reference.

FIELD OF THE INVENTION

The present invention relates generally to ovens and cooking devices, and more particularly to an induction cooking devices.

BACKGROUND OF THE INVENTION

Induction cooking is well known in the art. Induction technology works by creating a magnetic field that passes through, e.g., magnetic cookware (iron or steel), generating heat. Such induction technology applies an oscillating current to an electromagnet to produce an oscillating magnetic field. This magnetic field passes through the magnetic cookware, which generates heat in the cookware itself instead of the surface of a cooktop unit. Recently, induction cooking ranges have been developed for use in the home. Conventional counter-top induction cooktops have been developed that use this induction technology, but often present limited or rigid sets of features. The conventional induction cooking ranges are limited in their usefulness because they are often limited in functionality.

Various countertop ovens exist, including, e.g., microwave ovens. An exemplary counter-top oven is described in U.S. Pat. No. 6,201,217 to J. S. Moon, et al., of common assignee to the present invention, the contents of which are incorporated herein by reference in their entirety. Although, conventional counter-top ovens heat food, they often do so by more conventional microwave, or infrared heating methods. What is needed is an improved countertop cooktop that overcomes shortcomings of conventional countertop cooking devices.

SUMMARY OF THE INVENTION

The present invention sets forth various exemplary embodiments of apparatuses, systems, and methods for countertop cooking, which may provide improved induction cooking. According to an exemplary embodiment, the improved induction cooktop may allow for receiving a user-selected choice of a plurality of cooking modes.

In an exemplary embodiment of the present invention, an exemplary cooktop apparatus or system may include, e.g., but not limited to, an induction cooktop including any of various new and novel features.

According to an exemplary embodiment, an exemplary countertop induction cooktop cooking system, may include, e.g., but not limited to: an induction cooking unit which may in an exemplary embodiment include: an interface adapted to receive, store, and execute a plurality of instructions of a multistage programmable recipe may include at least one temperature or time using said induction cooking unit; a power supply adapted to couple said induction cooking unit to an external power source; a controller coupled to said power supply, said interface, and said induction cooking unit adapted to control said induction cooking unit according to said plurality of instructions of said multistage programmable recipe.

According to an exemplary embodiment, an exemplary method of cooking may include, e.g., but not limited to, receiving at an interface of an induction cooking unit a plurality of instructions of a multistage programmable recipe; storing said plurality of instructions in at least one memory; executing said plurality of instructions in a controller coupled to said at least one memory and said induction cooking unit, so as to control said induction cooking unit in accordance with said plurality of instructions of said multistage programmable recipe.

According to an exemplary embodiment, an exemplary method may include where the plurality of instructions may include three or more instructions.

According to an exemplary embodiment, an exemplary system may include where the interface may include: a plurality of buttons, each of said plurality of buttons associated with a given temperature range of heating of said induction cooking unit.

According to an exemplary embodiment, an exemplary system may include each of said plurality of buttons associated with said given temperature range of heating comprises at least one of: a low temperature; a medium low temperature; a medium temperature; a medium high temperature; a high temperature; or a sear temperature.

According to an exemplary embodiment, an exemplary system may include where the interface may include: an increase temperature button, and a decrease temperature button.

According to an exemplary embodiment, an exemplary system may include where the increase temperature button is adapted to receive an instruction to increase a temperature range setting of said induction cooking unit by an increment of temperature.

According to an exemplary embodiment, an exemplary system may be adjusted by increments of temperature of 10° F.

According to an exemplary embodiment, an exemplary system may include where the decrease temperature button is adapted to receive an instruction to decrease a temperature range setting of said induction cooking unit by an increment of temperature.

According to an exemplary embodiment, an exemplary system may include where the decrease in temperature is made in increments of 10° F.

According to an exemplary embodiment, an exemplary system may include where the interface may include: a plurality of buttons for programming operation of said induction cooking unit comprising at least one of: a program button adapted to receive a selection of a programming mode; a time button adapted to receive a time selection; a temperature level button; an increase temperature button; a decrease temperature button; a start program button; or a cancel program button.

According to an exemplary embodiment, an exemplary system may include where the interface may include: an alphanumeric display adapted to output an alphanumeric indication of at least one of: a temperature, a time, or a program stage.

According to an exemplary embodiment, an exemplary system may include where the induction cooking unit may be adapted to operate at temperatures as low as about 100° F. (Fahrenheit).

According to an exemplary embodiment, an exemplary system may include where the induction cooking unit may be adapted to disable operation when a sensed temperature exceeds an abnormally high threshold.

According to an exemplary embodiment, an exemplary system may include where the abnormally high threshold is approximately about 570° F.

According to an exemplary embodiment, an exemplary system may include where the induction cooking unit further comprises an extended glass surface adapted to extend to the edge of the unit.

According to an exemplary embodiment, an exemplary system may include where the induction cooking unit further comprises at least one ridge on a side wall extending an upper portion of said side wall over and away from any vents in said side wall.

According to an exemplary embodiment, an exemplary system may include where the interface comprises at least one of an angled or an arched control panel.

According to an exemplary embodiment, an exemplary system may include where the induction cooking unit comprises at least one accessory.

According to an exemplary embodiment, an exemplary system may include where the at least one accessory may include at least one or more of the following: a coffee maker; a grill comprising a dripping container; a circular grill; an oval grill; a pan; a pan having a green colored inner cooking surface; a pot; a pot having a green colored inner cooking surface; a steamer; a pot adapted to receive fondue forks; a pot adapted to receive a plurality of yogurt containers; a popcorn popper; a pressure cooker; an auto-stir container; a two-way motorized speed control, foldable stirring spoon; a spring loaded push and lock hinged locking cover for a pot or bowl; a spring loaded lid-locking system; a hands free automatic stirring system; a hands free automatic stirrer; a covered container comprising a safety valve; a covered container comprising a primary and secondary pressure valve system; an ellipse shaped grill; an ellipse shaped grill adapted to interlock with the surface of said induction cooktop; a grill comprising at least one of a removable drip pan or at least one handle; at least one glass covered pan or pot; a pot comprising a removable fondue plate; a pot comprising a removable fondue plate comprising a plurality of J-shaped fondue fork receiving openings; at least one fondue fork; a pot adapted to receive at least one of: a fondue plate, or a plurality of yogurt jars; a spinning stirrer; a metal pot or pan adapted for use with said induction cooktop; a plurality of handled pans comprising interlocking stackable handles; or a pan comprising at least one removable divider insert.

According to an exemplary embodiment, an exemplary system may include where the induction cooking unit may be adapted to sense removal of a cooking pot or pan and automatically turns said induction cooking unit off after a time duration.

In an exemplary embodiment of the present invention, an exemplary cooktop apparatus or system may include, e.g., but not limited to, a countertop induction cooktop cooking system, method, and computer program product, which may include, in an exemplary embodiment, an induction cooking unit; an interface adapted to receive, store, and execute a plurality of instructions of a multistage programmable recipe using said induction cooking unit; a power supply adapted to be coupled to a power source; a controller coupled to said power supply, said interface, and said induction cooking unit adapted to control said induction cooking unit according to said plurality of instructions of said multistage programmable recipe.

In an exemplary embodiment of the present invention, an exemplary cooktop apparatus or system may include, e.g., but not limited to, a system, method, and computer program product of cooking comprising: an induction cooking unit; receiving at an interface of an induction cooking unit a plurality of instructions of a multistage programmable recipe; storing said instructions in at least one memory; executing said instructions in a controller coupled to said memory and said induction cooking unit, so as to control said induction cooking unit in accordance with said instructions of said multistage programmable recipe.

A. Programmable Cooking Stages

In an exemplary embodiment of the present invention, an exemplary cooktop apparatus or system may include, e.g., but not limited to, a feature providing for programmable cooking stages. An induction cooktop with the ability to program the unit with up to, e.g., but not limited to, three different cooking stages. A controller with embedded software may enable a user to specify a temperature and a time for each stage—up to 99 hours and 99 minutes—which the user may select using the control panel of the unit. The controller may execute each stage by automatically adjusting the temperature of the unit.

B. Precise Temperature Adjustment

In an exemplary embodiment of the present invention, an exemplary cooktop apparatus or system may include, e.g., but not limited to, an induction cooktop that may allow a user to specify a desired temperature in increments of 10° F. The user may operate, e.g., but not limited to, buttons on an interface, or control panel to increase or decrease the temperature according to an exemplary embodiment of the present invention.

C. Low Temperature Cooking

In an exemplary embodiment of the present invention, an exemplary cooktop apparatus or system may include, e.g., but not limited to, an induction cooktop that may allow a user to cook at relatively lower temperatures. In particular, temperatures as low as 100° F.

D. Thermal Fuse Safety Mechanism

In an exemplary embodiment of the present invention, an exemplary cooktop apparatus or system may include, e.g., but not limited to, an improved induction cooktop may include a thermal fuse as a safety mechanism to, e.g., but not limited to, permanently disable cooktop units that reach abnormally high temperatures. (e.g. upwards of 570° F. indicating a potentially defective unit).

E. Cooking Modes

In an exemplary embodiment of the present invention, an exemplary cooktop apparatus or system may include, e.g., but not limited to, an induction cooktop, which may provide and/or display cooking modes, which may allow a user to select from, e.g., but not limited to: low; medium-low; medium; medium-high; high; and sear cooking modes, etc.

F. Extended Glass Surface

In an exemplary embodiment of the present invention, an exemplary cooktop apparatus or system may include, e.g., but not limited to, an induction cooktop having a ceramic glass surface that may extend to the edge of the unit to reduce the chances of liquid entering the interior of the unit. Instead, liquid may remain on the surface or drip down the sides of the unit to the countertop.

G. Side Wall Ridge

In an exemplary embodiment of the present invention, an exemplary cooktop apparatus or system may include, e.g., but not limited to, an induction cooktop may include a ridge on the side wall of the unit to further prevent liquid from entering the unit through air vents also positioned in the side wall. The addition of a ridge to the side wall of the unit may extend the upper portion of the side wall over and away from the air vents. Thus, liquid traveling down the side wall may drop from the ridge to the countertop reducing the chances of liquid entering the unit through the air vents, according to an exemplary embodiment.

H. Angled and Arched Control Panel

In an exemplary embodiment of the present invention, an exemplary cooktop apparatus or system may include, e.g., but not limited to, an induction cooktop may have an angled and arched control panel. The control panel may extend away from the unit at a downward angle to present an angled and more readable control panel to the user. Further, instead of a flat-faced control panel, the cooktop may add an arch shape to the face of the control panel to improve usability.

Further features and advantages of the invention, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of various exemplary embodiments, including a preferred embodiment of the invention, as illustrated in the accompanying drawings wherein like reference numbers generally indicate identical, functionally similar, and/or structurally similar elements.

FIG. 1I depicts another exemplary embodiment of another perspective view of an induction cooktop features a range of exemplary buttons including, e.g., but not limited to, a temperature increment, a temperature decrement, an alphanumeric display, a pause/clear button, a Prog button, a time button, a start button, a low, medium low, medium, medium high, high, and max sear button, etc., an exemplary glass top and exemplary red design on the exemplary glass cooktop, according to exemplary embodiments of the cooktop;

FIG. 1J depicts an exemplary embodiment of another front perspective view of an exemplary counter-top induction cooktop, illustrating exemplary features including, but not limited to, e.g., exemplary ventilation, exemplary top surface, exemplary control panel with exemplary liquid crystal display or exemplary light emitting diode display, and/or an exemplary heating source, etc., according to an exemplary embodiment of the present invention;

FIG. 1K depicts an exemplary embodiment of another front perspective view of an exemplary counter-top induction cooktop's exemplary display panel, illustrating exemplary features including, but not limited to, e.g., exemplary buttons including, e.g., but not limited to, a temperature increment, a temperature decrement, an alphanumeric display, a pause/clear button, a Prog button, a time button, a start button, a low, medium low, medium, medium high, high, and max sear button, etc., an exemplary table of exemplary temperature operating temperatures, and exemplary display messages of exemplary embodiments of the cooktop, according to exemplary embodiments of the present invention;

FIG. 4E further depicts an exemplary back edge orthographic view 462 of the exemplary grill according to a first embodiment of the present invention;

FIG. 4E further depicts an exemplary left side edge orthographic view 464 of the exemplary grill according to a first embodiment of the present invention;

FIG. 4E further depicts an exemplary right side edge orthographic view 466 of the exemplary grill according to a first embodiment of the present invention;

FIG. 4E further depicts an exemplary top orthographic view 468 of the exemplary grill without its optional handles or optional drip cup shown according to a first embodiment of the present invention;

FIG. 4E further depicts an exemplary a bottom orthographic view 470 of the exemplary grill according to a first embodiment of the present invention;

FIGS. 11A1, 11A2 and 11A3 (collectively, "FIG. 11A") depict an exemplary embodiment of an exemplary pressure popcorn maker and an exemplary popcorn container in an exemplary semi-transparent isometric view 1104, an exemplary top view 1102 and an exemplary side or front view 1100 illustrating an exemplary embodiment of the exemplary popcorn maker and container adapted to be used with or sold as a kit with an exemplary embodiment of an exemplary countertop cooktop, including various exemplary but non-limiting dimensions, according to an exemplary embodiment of the present invention;

FIGS. 11B1 and 11B2 (collectively, "FIG. 11B), depict an exemplary embodiment of an exemplary pressure popcorn maker including an exemplary top view 1120 and an exemplary side or front view 1110, respectively illustrating an exemplary embodiment of the exemplary popcorn maker adapted to be used with or sold as a kit with an exemplary embodiment of an exemplary countertop cooktop, including various exemplary but non-limiting dimensions, according to an exemplary embodiment of the present invention;

DETAILED DESCRIPTION OF PREFERRED EMBODIMENTS OF THE PRESENT INVENTION

A preferred and various other exemplary embodiments of the invention are discussed in detail below. While specific exemplary embodiments are discussed, it should be understood that this is done for illustration purposes only. A person skilled in the relevant art will recognize that other components and configurations can be used without parting from the spirit and scope of the invention.

Figure 1A:
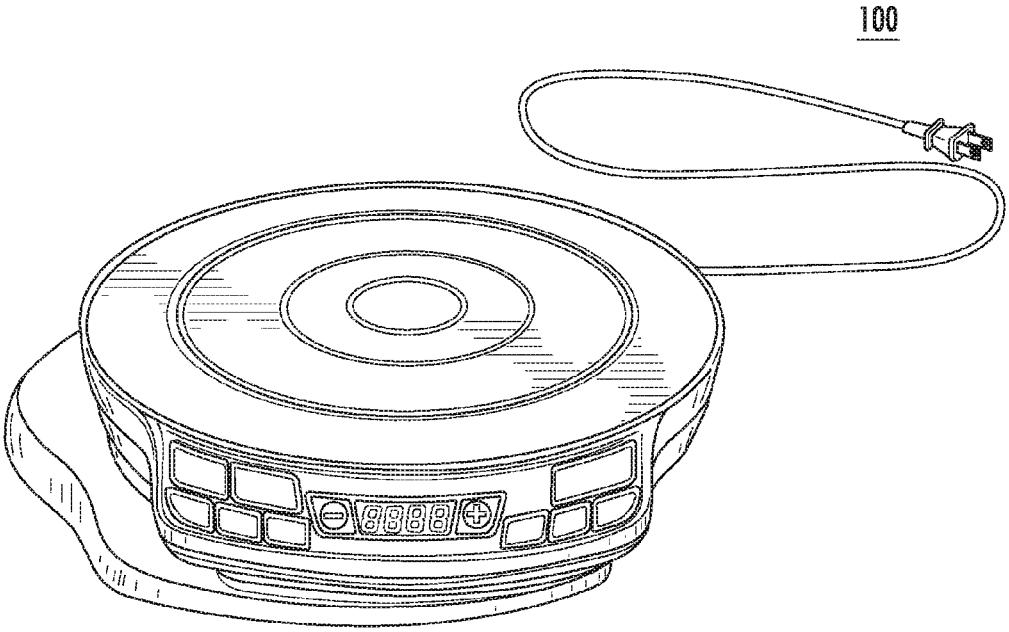
FIG. 1A depicts an exemplary embodiment of a perspective view of a counter-top induction cooktop, according to an exemplary embodiment of the present invention.

FIG. 1A depicts an exemplary embodiment of a perspective view of a counter-top induction cooktop, according to an exemplary embodiment of the present invention.

Figure 1B:
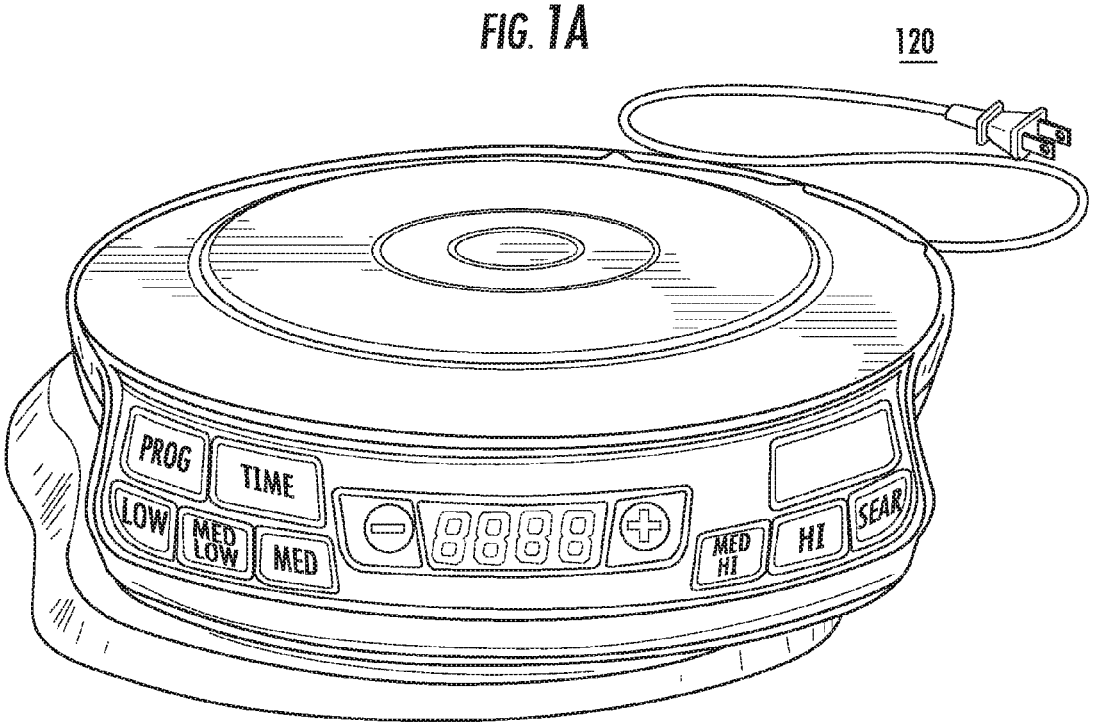
FIG. 1B depicts an exemplary embodiment of a close up view of an instrument panel of an exemplary counter-top induction cooktop, according to an exemplary embodiment of the present invention.

FIG. 1B depicts an exemplary embodiment of a close up view of an instrument panel of an exemplary counter-top induction cooktop, according to an exemplary embodiment of the present invention.

Figure 1C:
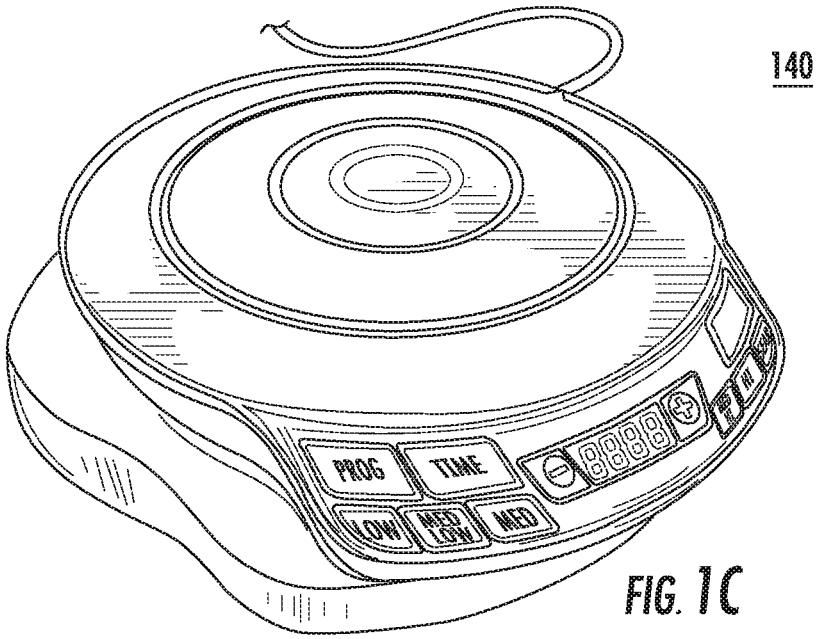
FIG. 1C depicts another exemplary embodiment of another perspective view of an exemplary counter-top induction cooktop, according to an exemplary embodiment of the present invention.

FIG. 1C depicts another exemplary embodiment of another perspective view of an exemplary counter-top induction cooktop, according to an exemplary embodiment of the present invention.

Figure 1L:
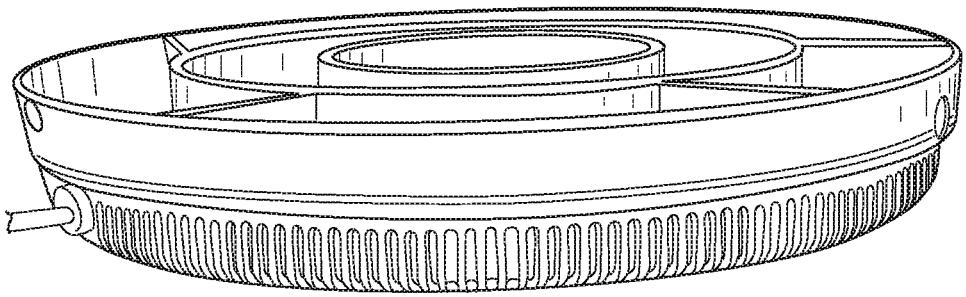
FIG. 1L depicts an exemplary embodiment of an exemplary back view of an exemplary counter-top induction cooktop illustrating exemplary vents and an exemplary overhang ledge overhanging the exemplary ventilation openings, according to exemplary embodiments of the present invention.
Figure 1M:
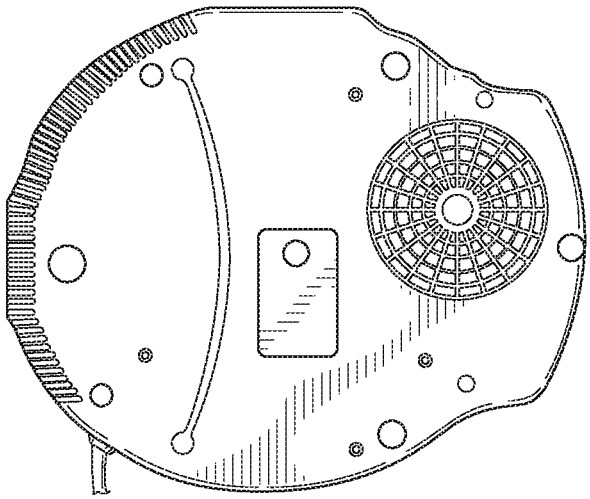
FIG. 1M depicts an exemplary embodiment of an exemplary bottom view of an exemplary counter-top induction cooktop illustrating exemplary fan and ventilation holes as well as exemplary silicone feet, according to exemplary embodiments of the present invention.
Figures 1D, 1E, 1F, 1G, 1H:
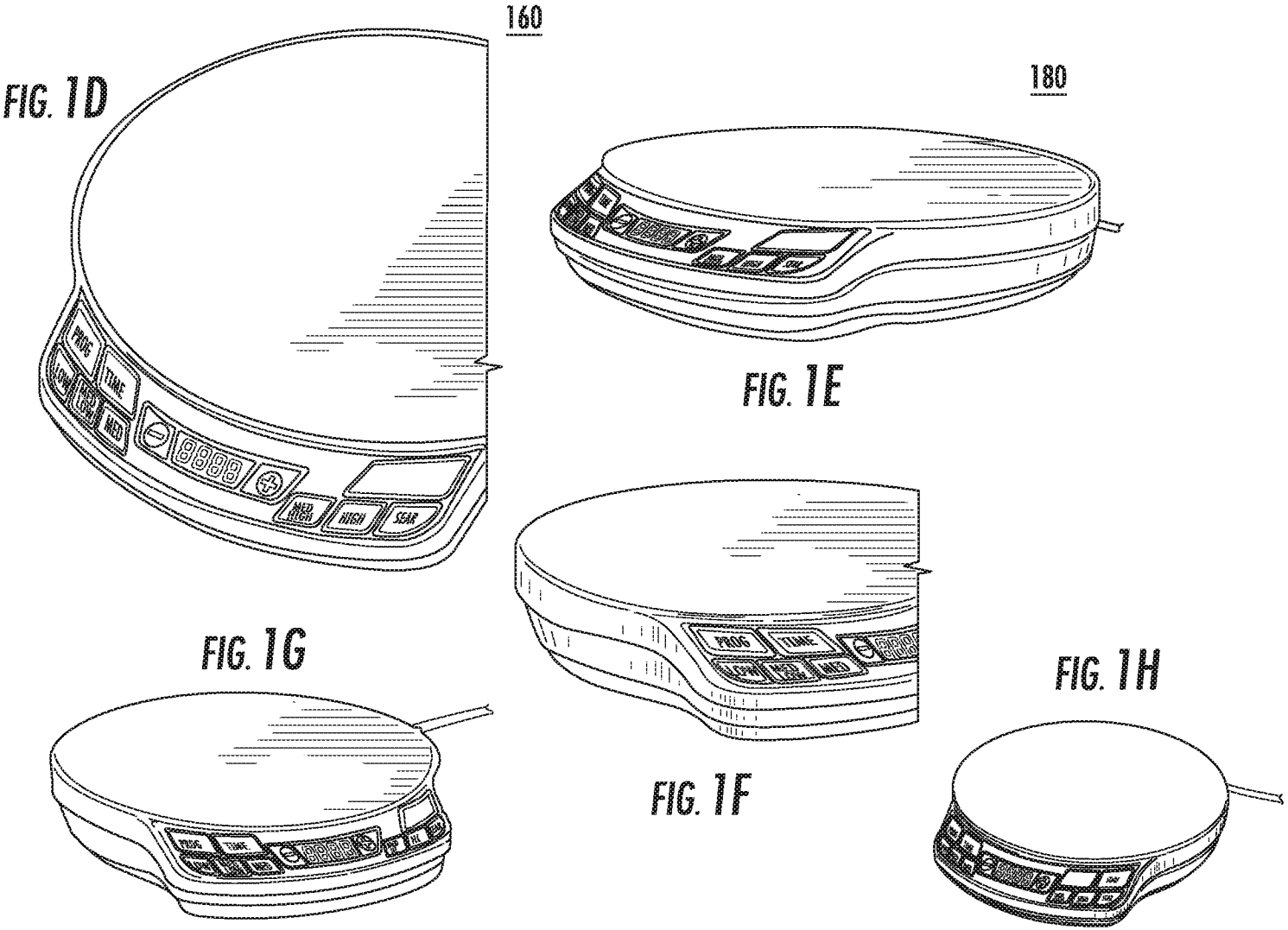
FIG. 1D depicts an exemplary embodiment of a partial close-up top perspective view of an exemplary counter-top induction cooktop, according to an exemplary embodiment of the present invention.
FIG. 1E depicts an exemplary embodiment of a partial close-up right side perspective view of an exemplary counter-top induction cooktop, according to an exemplary embodiment of the present invention.
FIG. 1F depicts an exemplary embodiment of a partial close-up left side perspective view of an exemplary counter-top induction cooktop, according to an exemplary embodiment of the present invention.
FIG. 1G depicts an exemplary embodiment of another perspective left/top view of an exemplary counter-top induction cooktop, according to an exemplary embodiment of the present invention.
FIG. 1H depicts an exemplary embodiment of another perspective right/top view of an exemplary counter-top induction cooktop, according to an exemplary embodiment of the present invention.

FIG. 1D depicts an exemplary embodiment of a partial close-up top perspective view of an exemplary counter-top induction cooktop, according to an exemplary embodiment of the present invention.

FIG. 1E depicts an exemplary embodiment of a partial close-up right side perspective view of an exemplary counter-top induction cooktop, according to an exemplary embodiment of the present invention.

FIG. 1F depicts an exemplary embodiment of a partial close-up left side perspective view of an exemplary counter-top induction cooktop, according to an exemplary embodiment of the present invention.

FIG. 1G depicts an exemplary embodiment of another perspective left/top view of an exemplary counter-top induction cooktop, according to an exemplary embodiment of the present invention.

FIG. 1H depicts an exemplary embodiment of another perspective right/top view of an exemplary counter-top induction cooktop, according to an exemplary embodiment of the present invention.

FIG. 1I depicts an exemplary image 182 illustrating another exemplary embodiment of another perspective view of an induction cooktop features a range of exemplary buttons including, e.g., but not limited to, a temperature increment, a temperature decrement, an alphanumeric display, a pause/clear button, a Prog button, a time button, a start button, a low, medium low, medium, medium high, high, and max sear button, etc., an exemplary glass top and exemplary red design on the exemplary glass cooktop, according to exemplary embodiments of the cooktop.

FIG. 1J depicts an exemplary diagram 184 illustrating an exemplary embodiment of another front perspective view of an exemplary counter-top induction cooktop, illustrating exemplary features including, but not limited to, e.g., exemplary ventilation, exemplary top surface, exemplary control panel with exemplary liquid crystal display or exemplary light emitting diode display, and/or an exemplary heating source, etc., according to an exemplary embodiment of the present invention.

FIG. 1K depicts exemplary diagram 186 illustrating an exemplary embodiment of another front perspective view of an exemplary counter-top induction cooktop's exemplary display panel, illustrating exemplary features including, but not limited to, e.g., exemplary buttons including, e.g., but not limited to, a temperature increment, a temperature decrement, an alphanumeric display, a pause/clear button, a Prog button, a time button, a start button, a low, medium low, medium, medium high, high, and max sear button, etc., exemplary diagram 188 illustrating an exemplary table of exemplary temperature operating temperatures, and exemplary diagram 190 illustrating exemplary display messages of exemplary embodiments of the cooktop, according to exemplary embodiments of the present invention.

FIG. 1L depicts an exemplary embodiment of an exemplary back view of an exemplary counter-top induction cooktop illustrating exemplary vents and an exemplary overhang ledge overhanging the exemplary ventilation openings, and a power cord connection, according to exemplary embodiments of the present invention.

FIG. 1M depicts an exemplary embodiment of an exemplary bottom view of an exemplary counter-top induction cooktop illustrating exemplary fan and ventilation holes as well as exemplary silicone feet, and exemplary power cord connection, according to exemplary embodiments of the present invention.

Figure 2A:
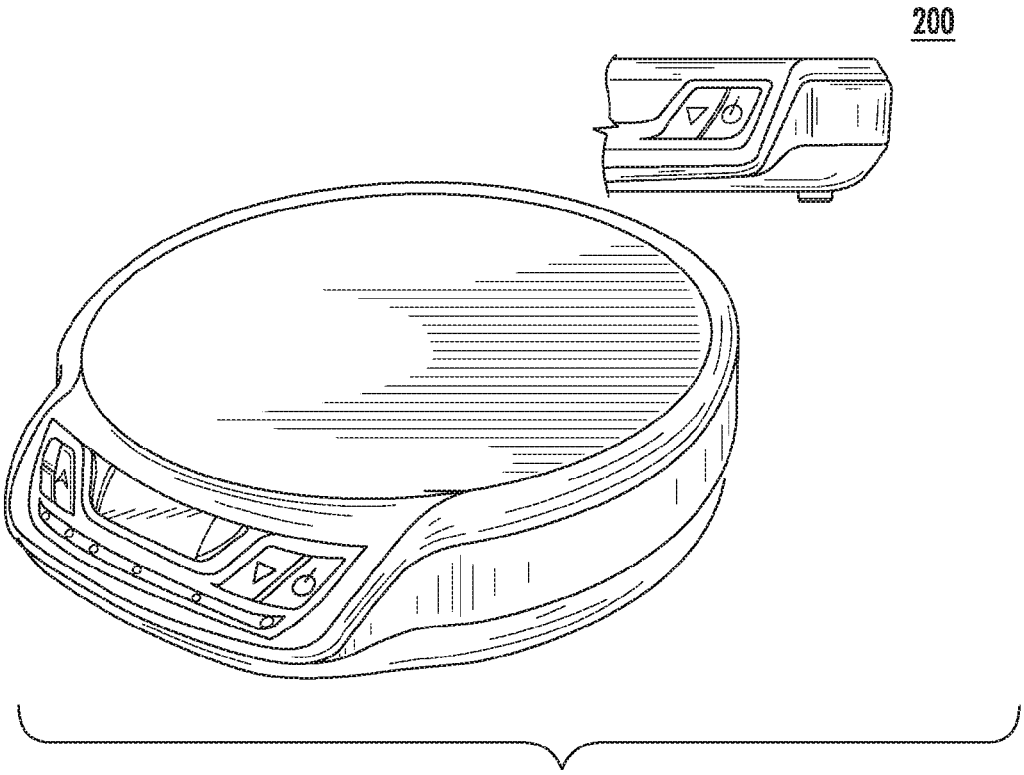
FIG. 2A depicts an exemplary embodiment of an exemplary perspective design for an exemplary counter-top induction cooktop, and exemplary instrument panel closeup, according to an exemplary embodiment of the present invention.

FIG. 2A depicts an exemplary embodiment of an exemplary perspective design for an exemplary counter-top induction cooktop, and exemplary instrument panel close-up, according to an exemplary embodiment of the present invention.

Figure 2B:
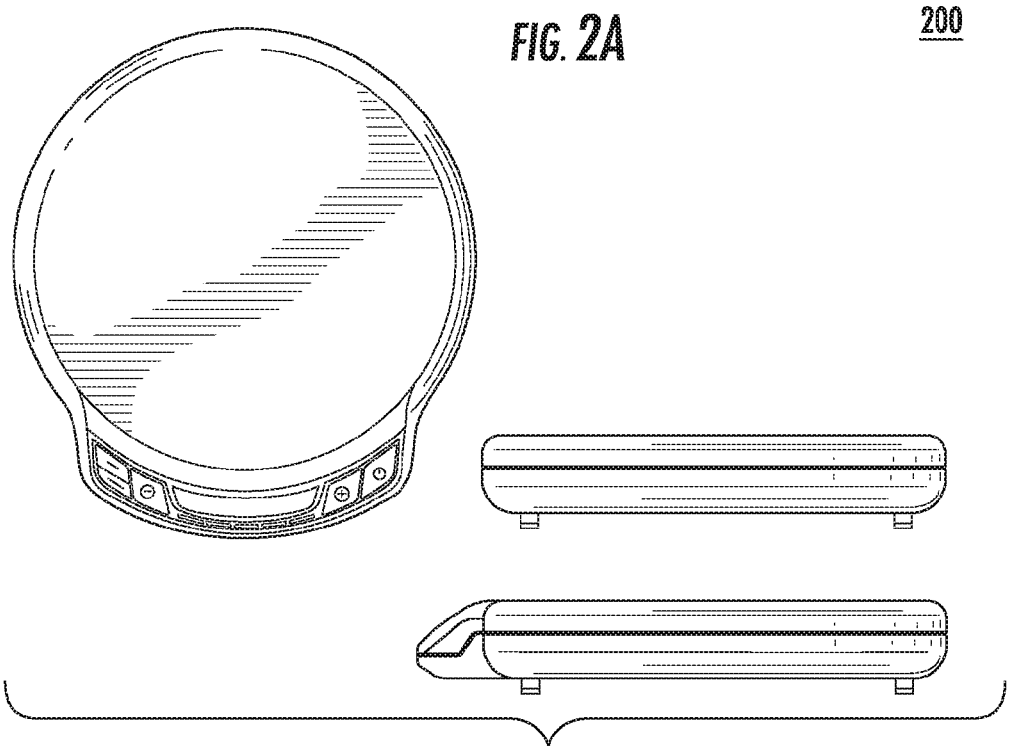
FIG. 2B depicts another exemplary embodiment of another exemplary perspective top view, front and side views for an exemplary counter-top induction cooktop, and exemplary instrument panel, according to an exemplary embodiment of the present invention.

FIG. 2B depicts another exemplary embodiment of another exemplary perspective top view, front and side views for an exemplary counter-top induction cooktop, and exemplary instrument panel, according to an exemplary embodiment of the present invention.

Figure 2C:
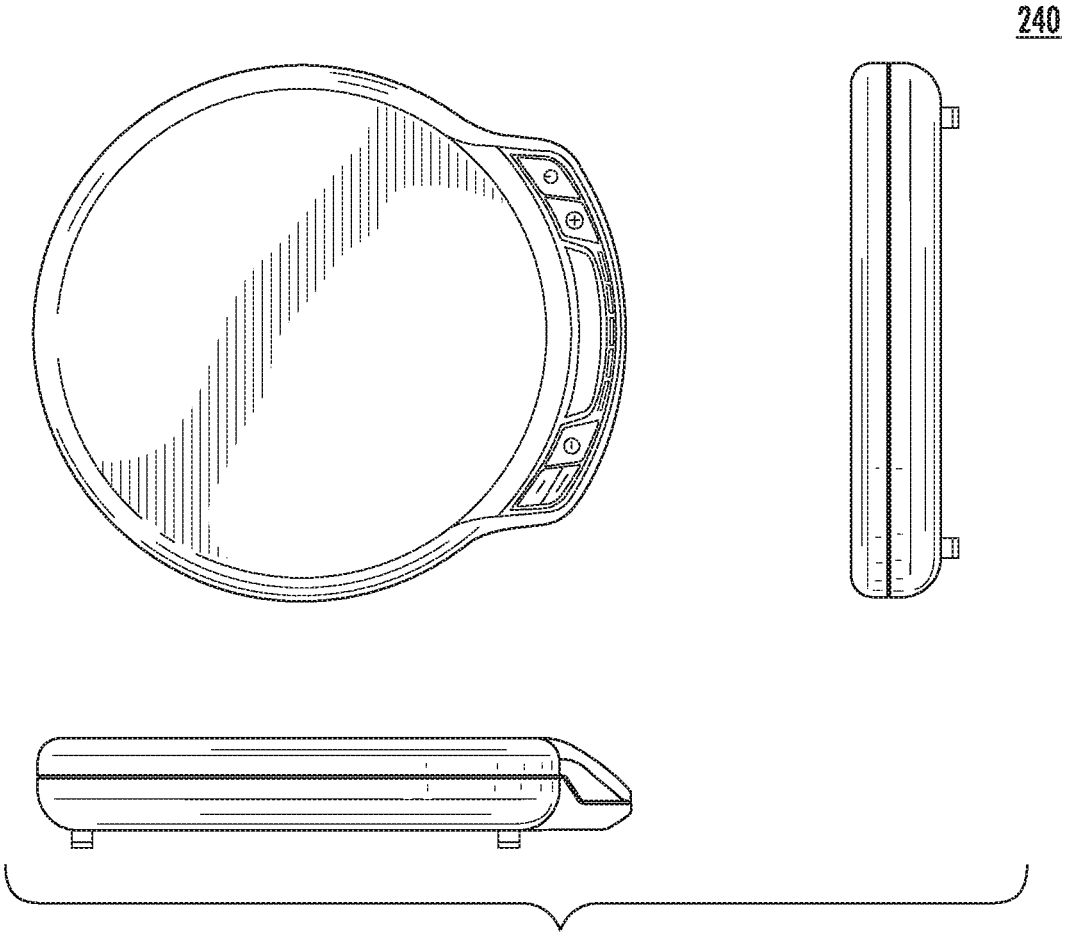
FIG. 2C depicts another exemplary embodiment of another exemplary top view, front and side views for an exemplary counter-top induction cooktop, and exemplary instrument panel closeup, including various exemplary but non-limiting dimensions, according to an exemplary embodiment of the present invention.

FIG. 2C depicts another exemplary embodiment of another exemplary top view, front and side views for an exemplary counter-top induction cooktop, and exemplary instrument panel close-up, including various exemplary but non-limiting dimensions, according to an exemplary embodiment of the present invention.

Figure 3A:
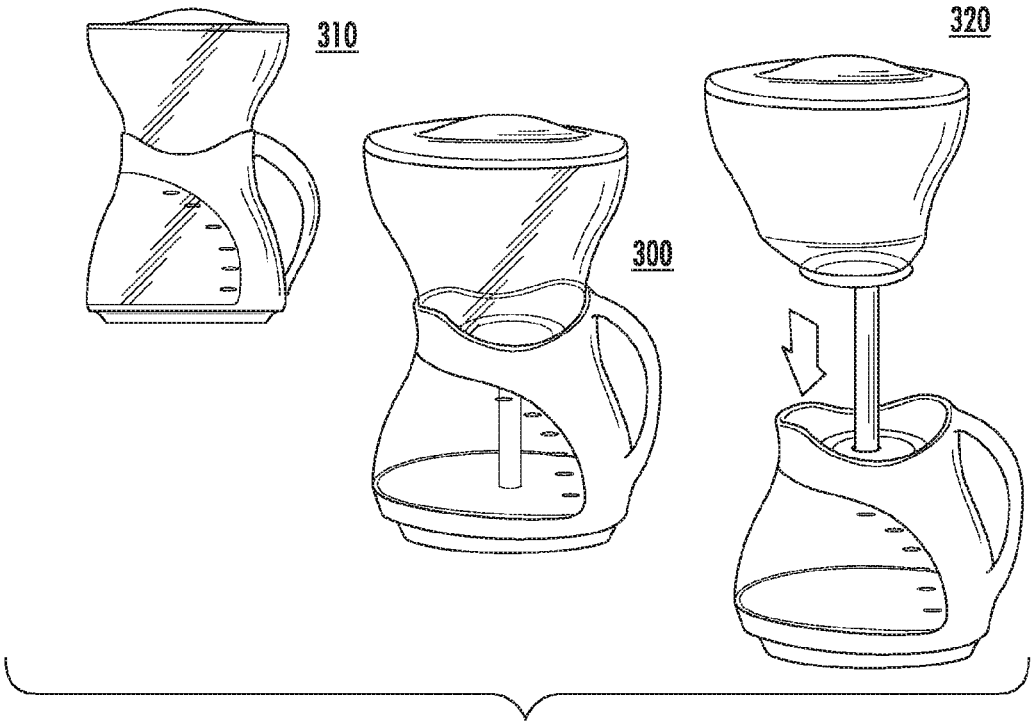
FIG. 3A depicts an exemplary embodiment of an exemplary vacuum coffee maker accessory including exemplary front view, perspective view, and exploded view of an exemplary accessory adapted for use with an exemplary counter-top induction cooktop, adapted to be used with or sold as a kit with an exemplary embodiment of an exemplary countertop cooktop, according to an exemplary embodiment of the present invention.

FIG. 3A depicts an exemplary embodiment of an exemplary vacuum coffee maker accessory including exemplary front view, perspective view, and exploded view of an exemplary accessory adapted for use with an exemplary counter-top induction cooktop, adapted to be used with or sold as a kit with an exemplary embodiment of an exemplary countertop cooktop, according to an exemplary embodiment of the present invention.

Figure 3B:
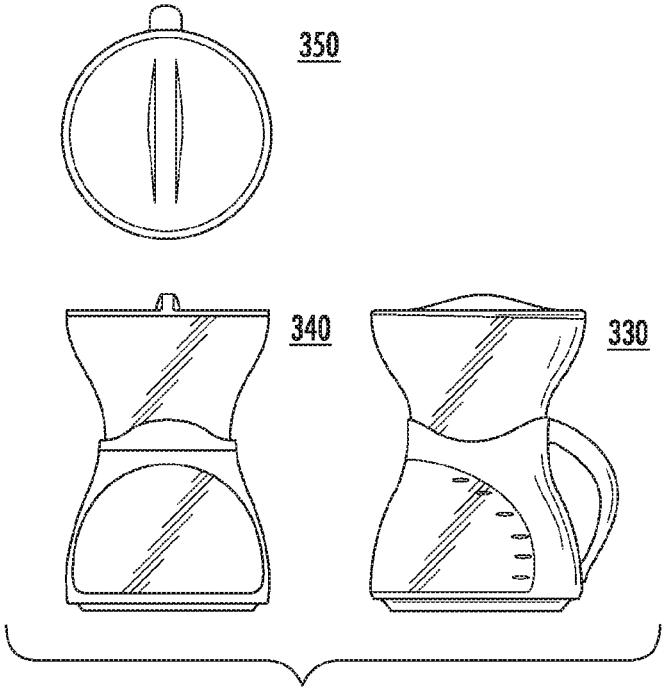
FIG. 3B depicts an exemplary embodiment of an exemplary vacuum coffee maker accessory including exemplary orthogonal front view, top view and side view, of an exemplary accessory adapted for use with an exemplary counter-top induction cooktop, according to an exemplary embodiment, adapted to be used with or sold as a kit with an exemplary embodiment of an exemplary countertop cooktop, including various exemplary but non-limiting dimensions, according to an exemplary embodiment of the present invention.

FIG. 3B depicts an exemplary embodiment of an exemplary vacuum coffee maker accessory including exemplary orthogonal front view, top view and side view, of an exemplary accessory adapted for use with an exemplary counter-top induction cooktop, according to an exemplary embodiment, adapted to be used with or sold as a kit with an exemplary embodiment of an exemplary countertop cooktop, including various exemplary but non-limiting dimensions, according to an exemplary embodiment of the present invention.

Figure 4A:
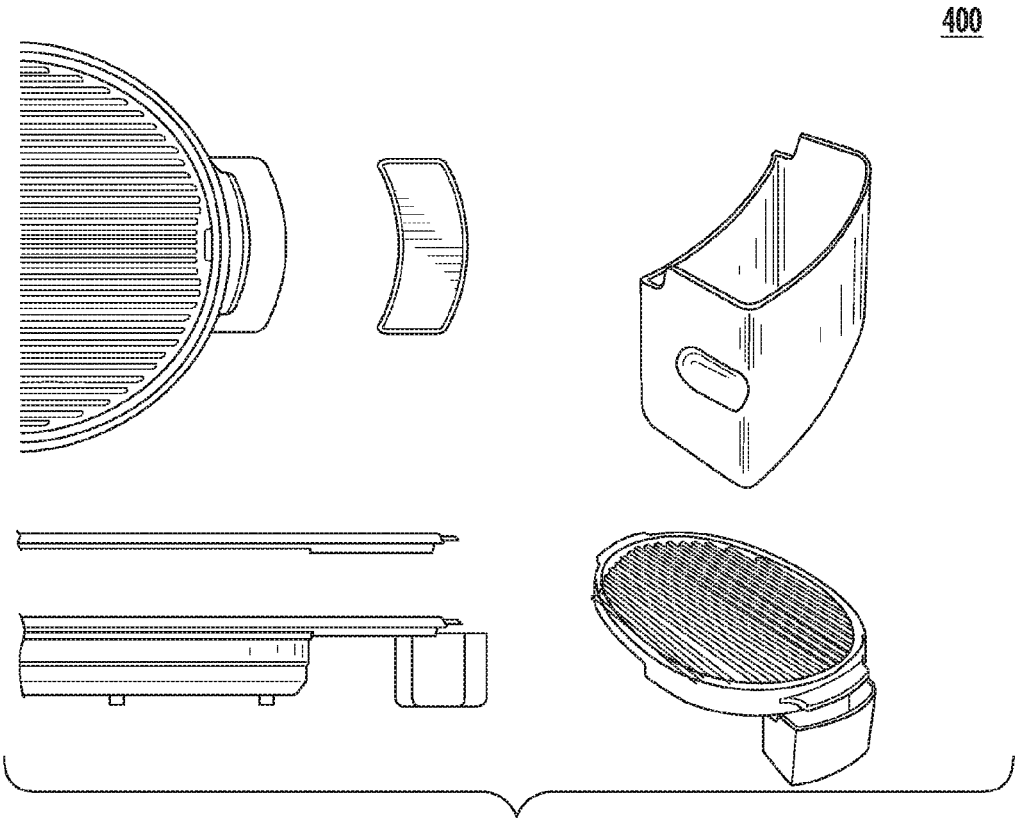
FIG. 4A depicts an exemplary embodiment of an exemplary barbeque (BBQ) grill container accessory including exemplary partial top view, side view of exemplary drip container, orthogonal perspective view of the exemplary drip container, handle, exemplary edge view of the overhang of the exemplary grill over the edge of the exemplary counter-top induction cooktop, according to an exemplary embodiment, adapted to be used with or sold as a kit with an exemplary embodiment of an exemplary countertop cooktop, including various exemplary but non-limiting dimensions, according to an exemplary embodiment of the present invention.

FIG. 4A depicts an exemplary embodiment of an exemplary barbeque (BBQ) grill container accessory including exemplary partial top view, side view of exemplary drip container, orthogonal perspective view of the exemplary drip container, handle, exemplary edge view of the overhang of the exemplary grill over the edge of the exemplary counter-top induction cooktop, according to an exemplary embodiment, adapted to be used with or sold as a kit with an exemplary embodiment of an exemplary countertop cooktop, including various exemplary but non-limiting dimensions, according to an exemplary embodiment of the present invention.

Figure 4B:
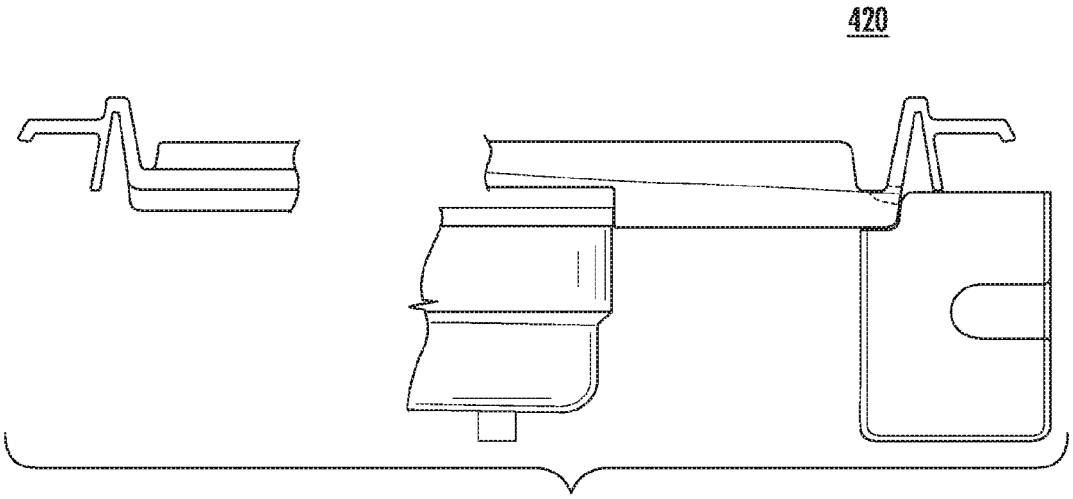
FIG. 4B depicts an exemplary embodiment of an exemplary close-up edge detailed view of an exemplary handle of an exemplary barbeque (BBQ) grill container accessory including exemplary partial edge views of the handles, exemplary drip container and exemplary induction cooktop, according to an exemplary embodiment, adapted to be used with or sold as a kit with an exemplary embodiment of an exemplary countertop cooktop, including various exemplary but non-limiting dimensions, according to an exemplary embodiment of the present invention.

FIG. 4B depicts an exemplary embodiment of an exemplary close-up edge detailed view of an exemplary handle of an exemplary barbeque (BBQ) grill container accessory including exemplary partial edge views of the handles, exemplary drip container and exemplary induction cooktop, according to an exemplary embodiment, adapted to be used with or sold as a kit with an exemplary embodiment of an exemplary countertop cooktop, including various exemplary but non-limiting dimensions, according to an exemplary embodiment of the present invention.

Figure 4C:
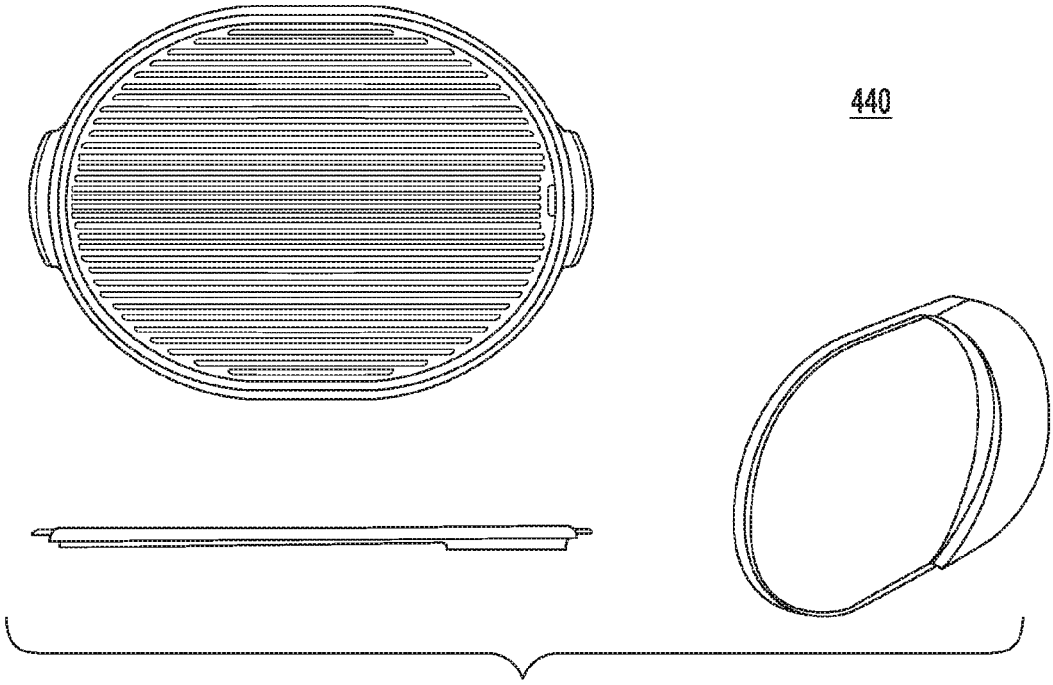
FIG. 4C depicts an exemplary embodiment of an exemplary edge view, top view, and bottom (or back) view of an exemplary oval grill including an exemplary drip hole of an exemplary barbeque (BBQ) grill container accessory for an exemplary induction cooktop, according to an exemplary embodiment, adapted to be used with or sold as a kit with an exemplary embodiment of an exemplary countertop cooktop, including various exemplary but non-limiting dimensions, according to an exemplary embodiment of the present invention.

FIG. 4C depicts an exemplary embodiment of an exemplary edge view, top view, and bottom (or back) view of an exemplary oval grill including an exemplary drip hole of an exemplary barbeque (BBQ) grill container accessory for an exemplary induction cooktop, according to an exemplary embodiment, adapted to be used with or sold as a kit with an exemplary embodiment of an exemplary countertop cooktop, including various exemplary but non-limiting dimensions, according to an exemplary embodiment of the present invention.

Figure 4D:
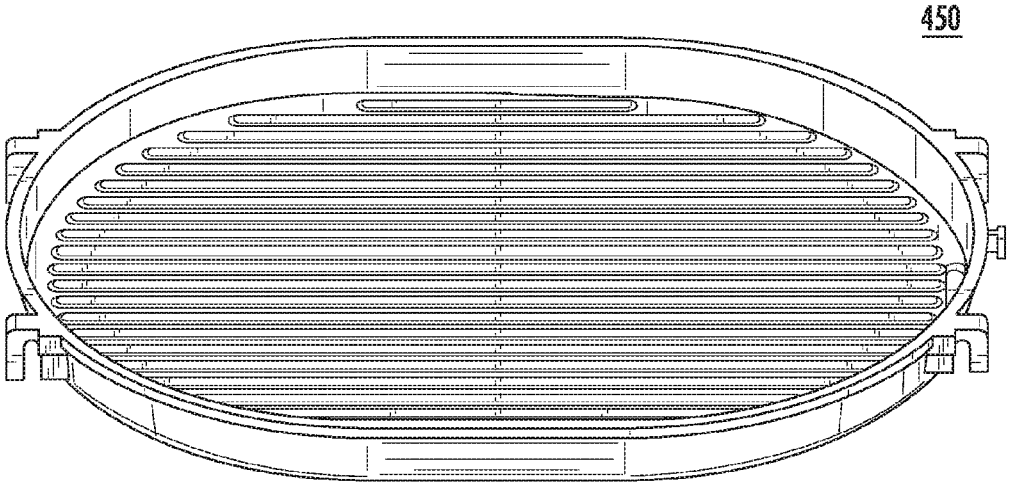
FIG. 4D depicts an exemplary isometric perspective top view of an exemplary grill, which may be a cast iron grill in one exemplary embodiment, according to a first exemplary embodiment of the present invention.

FIG. 4D depicts an exemplary isometric perspective top view of an exemplary grill, which may be a cast iron grill in one exemplary embodiment, according to a first exemplary embodiment of the present invention.

Figure 4E:
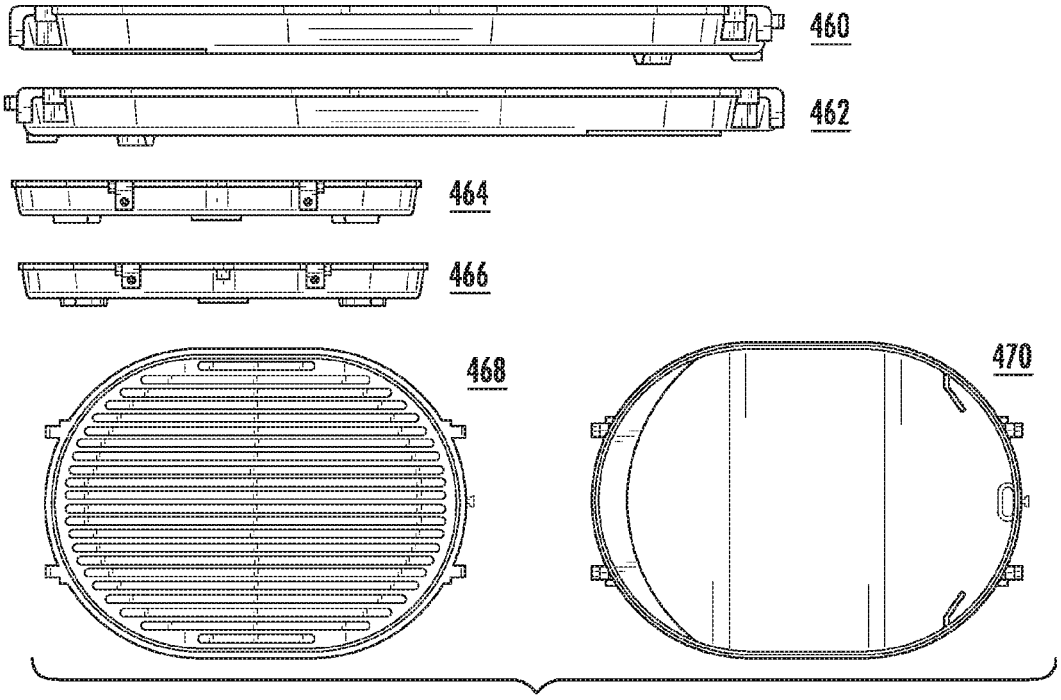
FIG. 4E depicts an exemplary front edge orthographic view 460 of an the grill according to a first embodiment of the present invention.

FIG. 4E depicts an exemplary front edge orthographic view 460 of an the grill according to a first embodiment of the present invention.

FIG. 4E further depicts an exemplary back edge orthographic view 462 of the exemplary grill according to a first embodiment of the present invention.

FIG. 4E further depicts an exemplary left side edge orthographic view 464 of the exemplary grill according to a first embodiment of the present invention.

FIG. 4E further depicts an exemplary right side edge orthographic view 466 of the exemplary grill according to a first embodiment of the present invention.

FIG. 4E further depicts an exemplary top orthographic view 468 of the exemplary grill without its optional handles or optional drip cup shown according to a first embodiment of the present invention.

FIG. 4E further depicts an exemplary a bottom orthographic view 470 of the exemplary grill according to a first embodiment of the present invention.

Figure 4F:
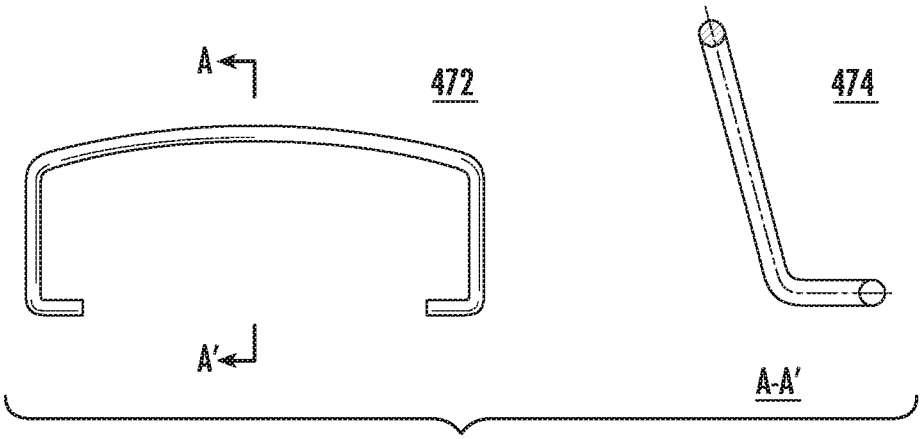
FIG. 4F further depicts an exemplary side view and exemplary edge view of an exemplary optional handle for one exemplary embodiment of an exemplary grill, which may be adapted for used with an induction cooktop, or a traditional range such as, e.g., but not limited to, an electric or gas range, according to exemplary embodiments of the present invention.

FIG. 4F further depicts an exemplary side view and exemplary edge view of an exemplary optional handle for one exemplary embodiment of an exemplary grill, which may be adapted for used with an induction cooktop, or a traditional range such as, e.g., but not limited to, an electric or gas range, according to exemplary embodiments of the present invention.

According to an exemplary embodiment, an exemplary grill may be adapted to be coupled to, and/or to be connected, and/or to be attached an exemplary induction cooktop, or even, in an exemplary embodiment, a conventional range top electric and/or gas burner. According to an exemplary embodiment, the exemplary grill may be constructed out of any of various well known resilient materials including, e.g., but not limited to, glass, metal, stainless steel, cast iron, aluminum, etc. According to an exemplary embodiment, the grill may include a hole to allow grease to drip through. According to exemplary embodiments, the grill may further include one or more handles. According to an exemplary embodiment, an exemplary grill may include an exemplary drip pan. According to an exemplary embodiment, an exemplary grill may include an exemplary coupler, adapted for coupling to, e.g., but not limited to, an induction cooktop, a conventional oven range, etc.

Figure 4G:
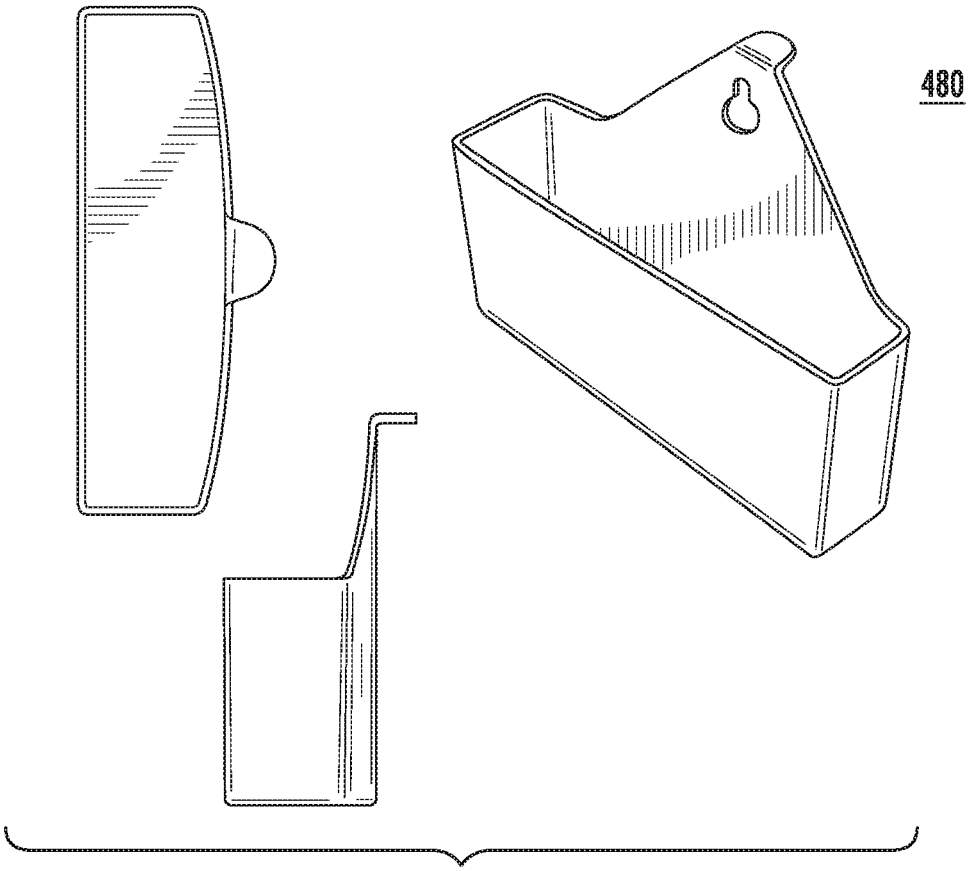
FIG. 4G further depicts an exemplary top orthographic view, side orthographic view, and exemplary isometric view of an exemplar embodiment of a drip cup which may be used with an exemplary grill according to an exemplary embodiment of the present invention.

FIG. 4G further depicts an exemplary top orthographic view, side orthographic view, and exemplary isometric view of an exemplar embodiment of a drip cup which may be used with an exemplary grill according to an exemplary embodiment of the present invention. According to one exemplary embodiment, an exemplary drip pan may be designed to be compact for packaging.

Figure 5:
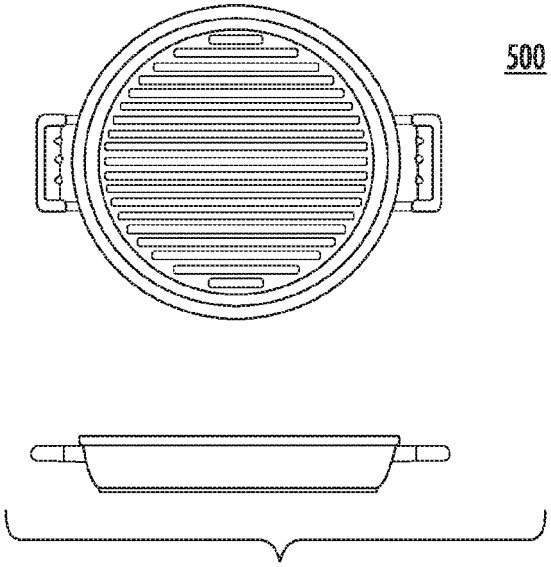
FIG. 5 depicts an exemplary embodiment of a top view and an edge view of an exemplary circular grill pan, including exemplary handles similar to those depicted in FIG. 7 in one exemplary embodiment, adapted to be used with or sold as a kit with an exemplary embodiment of an exemplary countertop cooktop, including various exemplary but non-limiting dimensions, according to an exemplary embodiment of the present invention.
Figure 7:
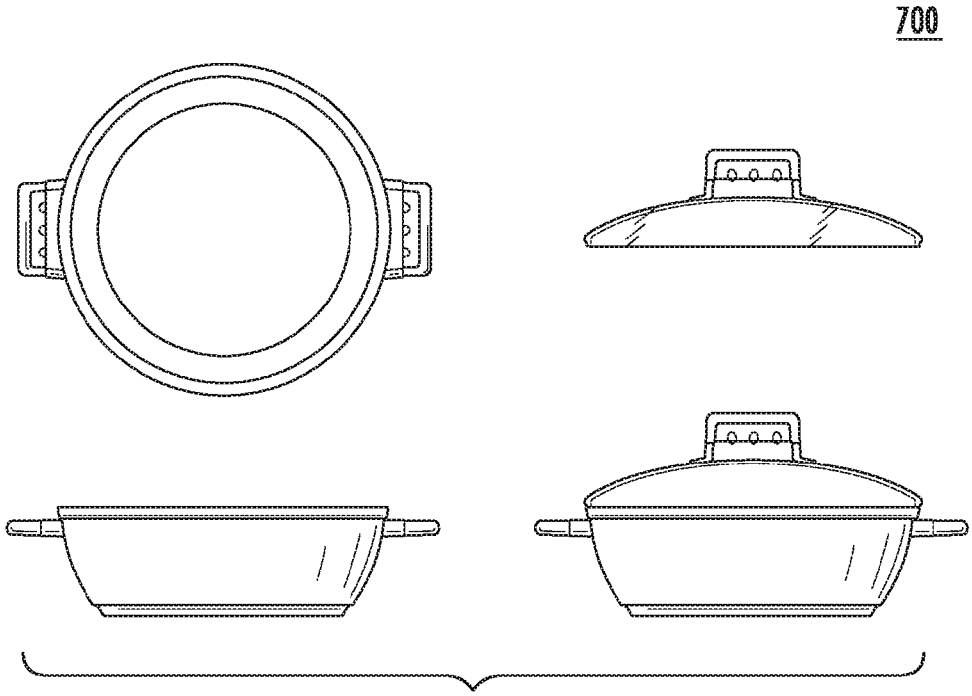
FIG. 7 depicts an exemplary embodiment of a top view and several edge views of an exemplary circular pot and exemplary circular lid, including exemplary handles similar to those depicted in FIG. 5 in one exemplary embodiment, adapted to be used with or sold as a kit with an exemplary embodiment of an exemplary countertop cooktop, including various exemplary but non-limiting dimensions, according to an exemplary embodiment of the present invention.

FIG. 5 depicts an exemplary embodiment of a top view and an edge view of an exemplary circular grill pan, including exemplary handles similar to those depicted in FIG. 7 in one exemplary embodiment, adapted to be used with or sold as a kit with an exemplary embodiment of an exemplary countertop cooktop, including various exemplary but non-limiting dimensions, according to an exemplary embodiment of the present invention.

Figure 6:
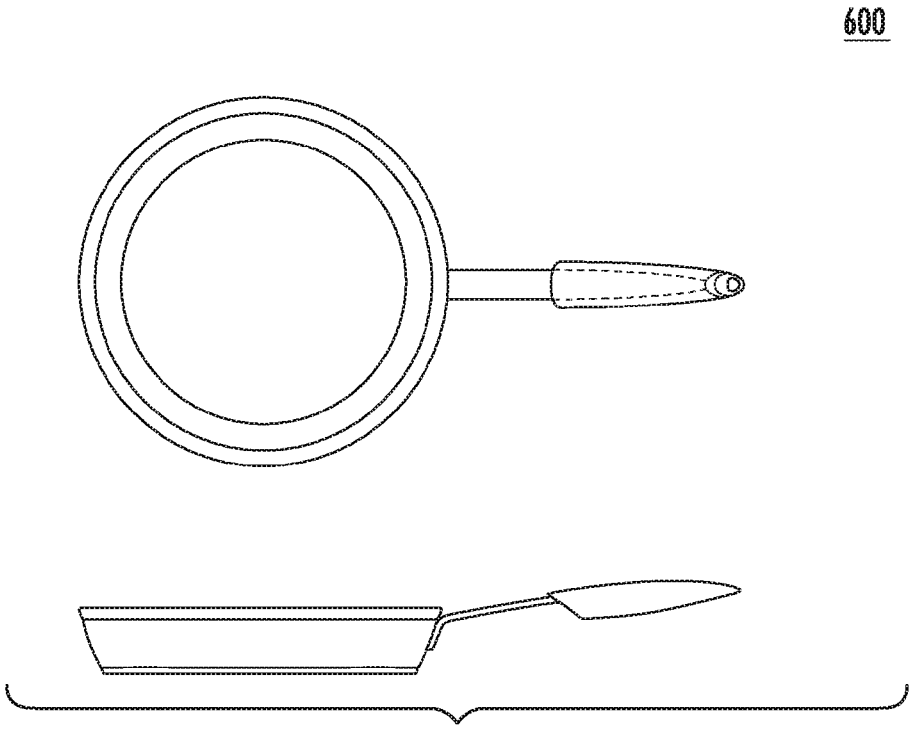
FIG. 6 depicts an exemplary embodiment of a top view and an edge view of an exemplary circular frying pan, including an exemplary handle, adapted to be used with or sold as a kit with an exemplary embodiment of an exemplary countertop cooktop, including various exemplary but non-limiting dimensions, according to an exemplary embodiment of the present invention.

FIG. 6 depicts an exemplary embodiment of a top view and an edge view of an exemplary circular frying pan, including an exemplary handle, adapted to be used with or sold as a kit with an exemplary embodiment of an exemplary countertop cooktop, including various exemplary but non-limiting dimensions, according to an exemplary embodiment of the present invention.

FIG. 7 depicts an exemplary embodiment of a top view and several edge views of an exemplary circular pot and exemplary circular lid, including exemplary handles similar to those depicted in FIG. 5 in one exemplary embodiment, adapted to be used with or sold as a kit with an exemplary embodiment of an exemplary countertop cooktop, including various exemplary but non-limiting dimensions, according to an exemplary embodiment of the present invention.

Figure 8A:
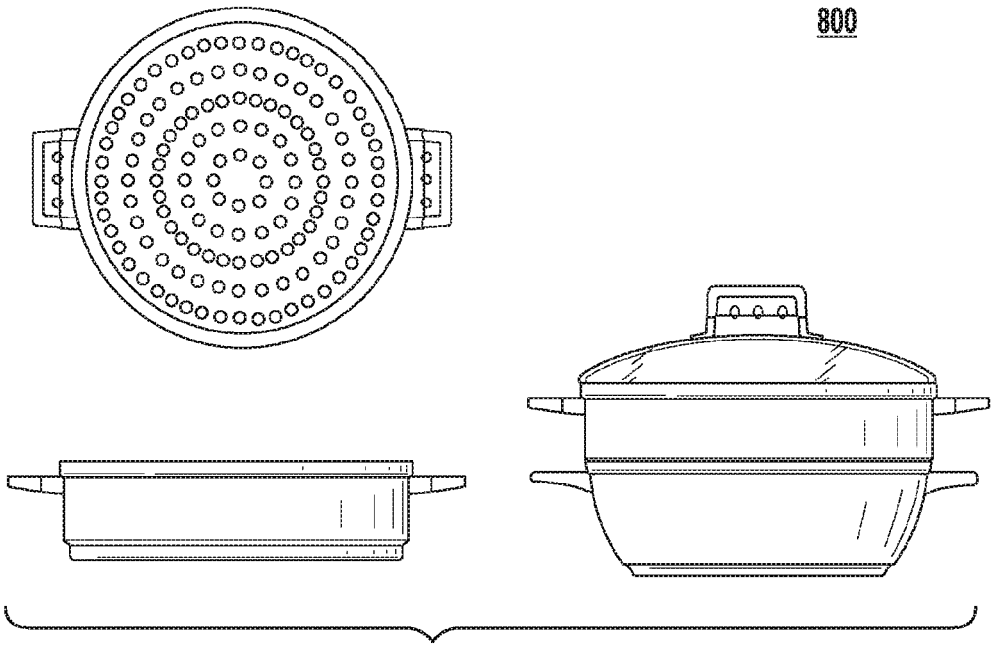
FIG. 8A depicts an exemplary embodiment of a top view and several edge views of an exemplary steam pot, as may be adapted for use with the exemplary circular pot and exemplary circular lid as set forth in the exemplary embodiment of FIG. 7, including exemplary handles similar to those depicted in FIGS. 5 and 7, in one exemplary embodiment, adapted to be used with or sold as a kit with an exemplary embodiment of an exemplary countertop cooktop, including various exemplary but non-limiting dimensions, according to an exemplary embodiment of the present invention.
Figure 8B:
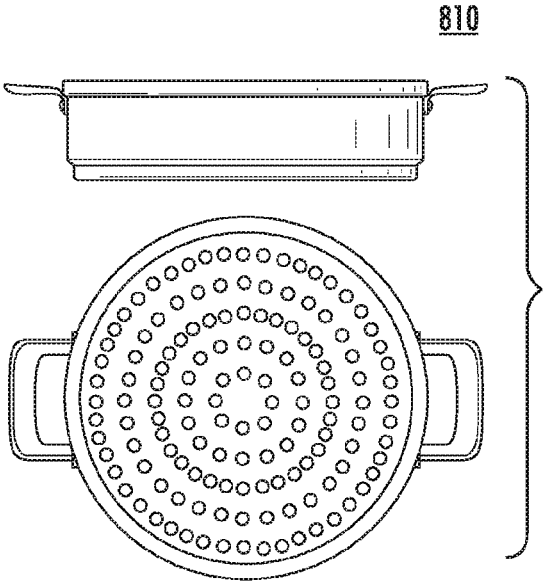
FIG. 8B depicts an exemplary embodiment of an exemplary top view and exemplary edge view of another exemplary steamer.
Figure 8C:
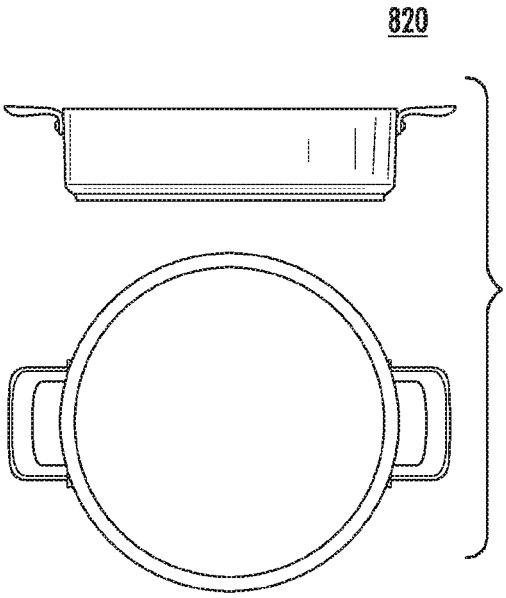
FIG. 8C depicts an exemplary embodiment of an exemplary top view and exemplary edge view of another exemplary pot with exemplary one or more handles.

FIG. 8A depicts an exemplary embodiment of a top view and several edge views of an exemplary steam pot, as may be adapted for use with the exemplary circular pot and exemplary circular lid as set forth in the exemplary embodiment of FIG. 7, including exemplary handles similar to those depicted in FIGS. 5 and 7, in one exemplary embodiment, adapted to be used with or sold as a kit with an exemplary embodiment of an exemplary countertop cooktop, including various exemplary but non-limiting dimensions, according to an exemplary embodiment of the present invention.

Figure 9A:
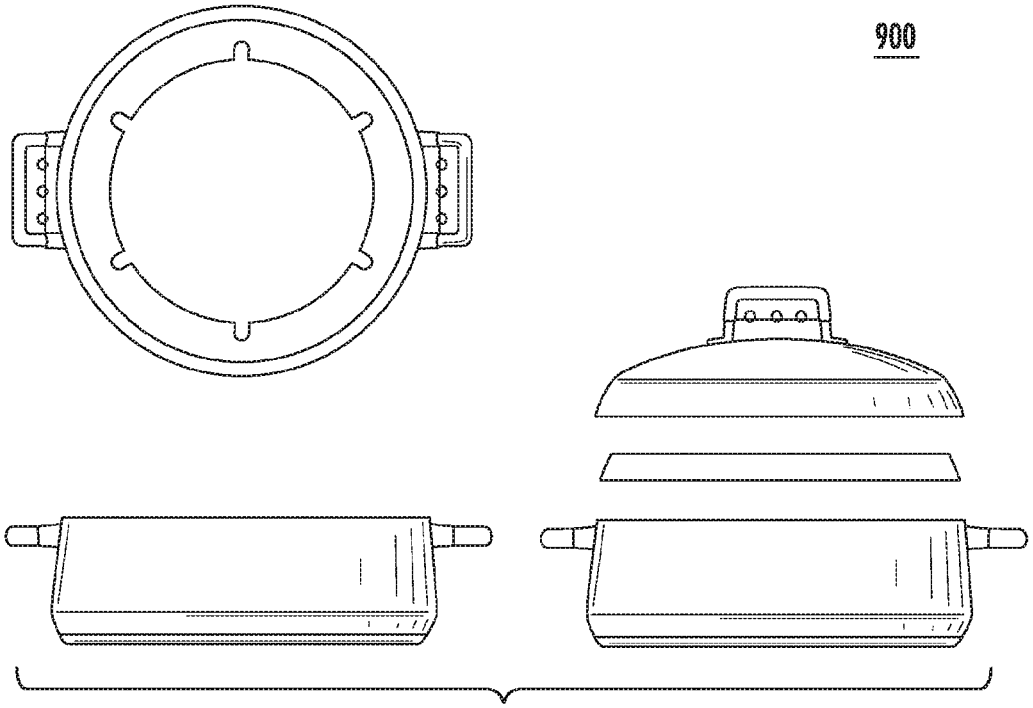
FIG. 9A depicts an exemplary embodiment of a top view and several edge views of an exemplary steam pot, as may be adapted for use with the exemplary circular fondue pot, including an exemplary insert to support exemplary forks, as well as an exemplary circular pot and an exemplary circular lid, including exemplary handles similar to those depicted in FIGS. 5, 7, 8A, 9A, and 10A, in one exemplary embodiment, adapted to be used with or sold as a kit with an exemplary embodiment of an exemplary countertop cooktop, including various exemplary but non-limiting dimensions, according to an exemplary embodiment of the present invention.

FIG. 9A depicts an exemplary embodiment of a top view and several edge views of an exemplary steam pot, as may be adapted for use with the exemplary circular fondue pot, including an exemplary insert to support exemplary forks, as well as an exemplary circular pot and an exemplary circular lid, including exemplary handles similar to those depicted in FIGS. 5, 7, 8A, 9A, and 10A, in one exemplary embodiment, adapted to be used with or sold as a kit with an exemplary embodiment of an exemplary countertop cooktop, including various exemplary but non-limiting dimensions, according to an exemplary embodiment of the present invention.

Figure 9B:
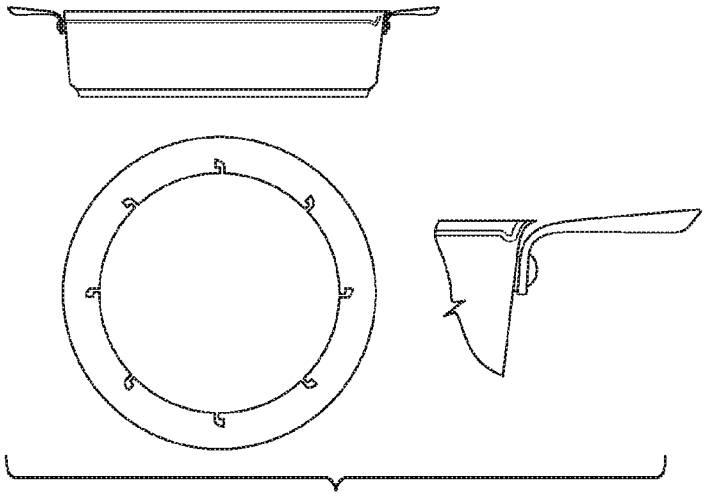
FIG. 9B depicts an exemplary embodiment of an exemplary top view and exemplary edge view of another exemplary fondue pot according to an exemplary embodiment.

FIG. 9B depicts an exemplary embodiment of an exemplary top view and exemplary edge view of another exemplary fondue pot according to an exemplary embodiment.

Figure 9C:
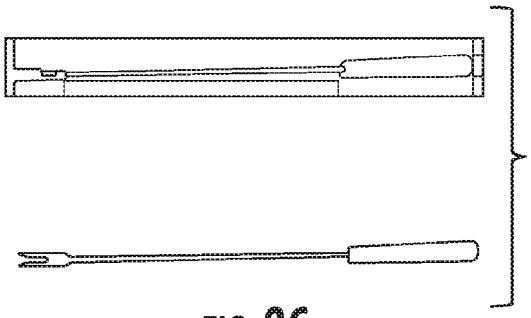
FIG. 9C depicts an exemplary embodiment of an exemplary fondue fork.

FIG. 9C depicts an exemplary embodiment of an exemplary fondue fork.

Figure 9D:
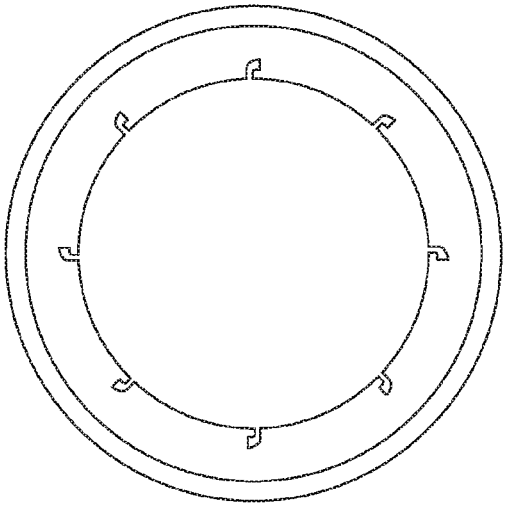
FIG. 9D depicts an exemplary top view of an exemplary fondue fork holder portion including exemplary J or P shaped fork holding holes according to an exemplary embodiment.

FIG. 9D depicts an exemplary top view of an exemplary fondue fork holder portion including exemplary J or P shaped fork holding holes according to an exemplary embodiment. According to an exemplary embodiment, the fondue plate, may be adapted to receive and to resiliently hold an exemplary fondue fork, to prevent the fork from falling into the heated liquid in the exemplary fondue pot.

Figure 9E:
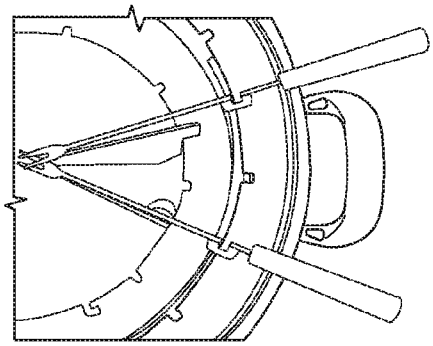
FIGS. 9E and 9F illustrate exemplary embodiments of exemplary fork holding holes according to an exemplary embodiment.
Figure 9F:
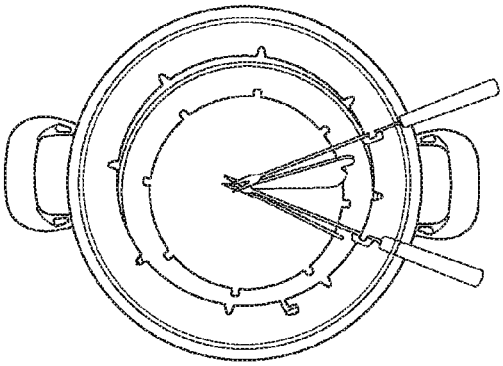

FIGS. 9E and 9F illustrate exemplary embodiments of exemplary fork holding holes according to an exemplary embodiment.

Figure 10A:
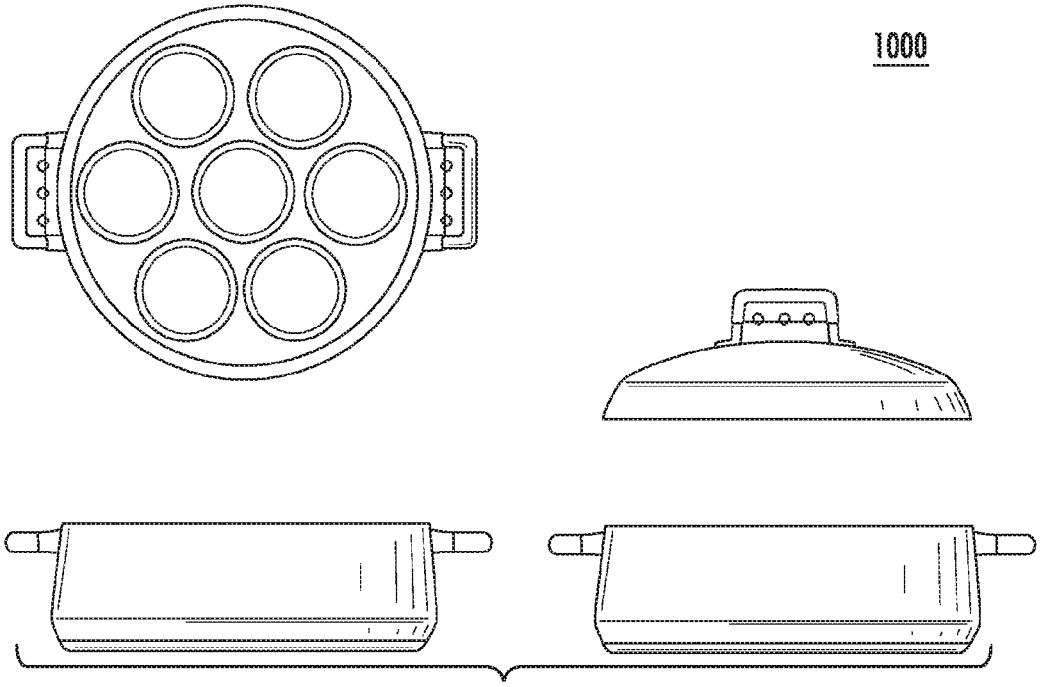
FIG. 10A depicts an exemplary embodiment of a top view and several edge views of an exemplary yogurt maker and pot, as may be adapted for use with an exemplary holder of, or adapted to receive, exemplary yogurt jars as depicted in a top view in FIG. 10A, the exemplary circular yogurt pot, may include an exemplary circular pot and an exemplary circular lid, including exemplary handles similar to those depicted in FIGS. 5, 7, 8A, and 9A, in one exemplary embodiment, adapted to be used with or sold as a kit with an exemplary embodiment of an exemplary countertop cooktop, including various exemplary but non-limiting dimensions, according to an exemplary embodiment of the present invention.

FIG. 10A depicts an exemplary embodiment of a top view and several edge views of an exemplary yogurt maker and pot, as may be adapted for use with an exemplary holder of, or adapted to receive, exemplary yogurt jars as depicted in a top view in FIG. 10A, the exemplary circular yogurt pot, may include an exemplary circular pot and an exemplary circular lid, including exemplary handles similar to those depicted in FIGS. 5, 7, 8A, and 9A, in one exemplary embodiment, adapted to be used with or sold as a kit with an exemplary embodiment of an exemplary countertop cooktop, including various exemplary but non-limiting dimensions, according to an exemplary embodiment of the present invention.

Figure 10B:
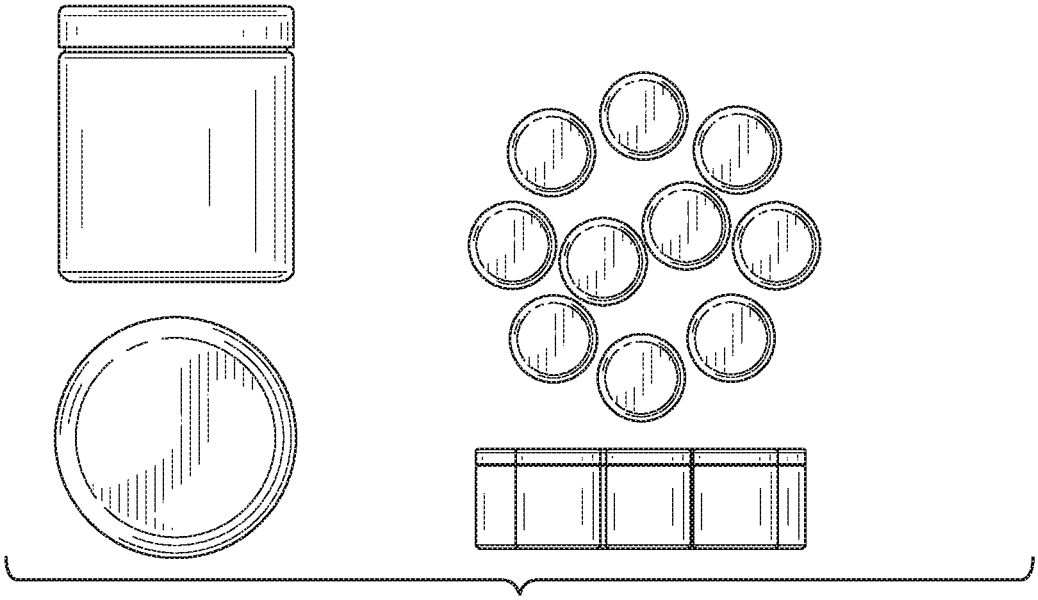
FIG. 10B depicts an exemplary embodiment of several top and side views of an exemplary yogurt maker jar.

FIG. 10B depicts an exemplary embodiment of several top and side views of an exemplary yogurt maker jar.

Figure 10C:
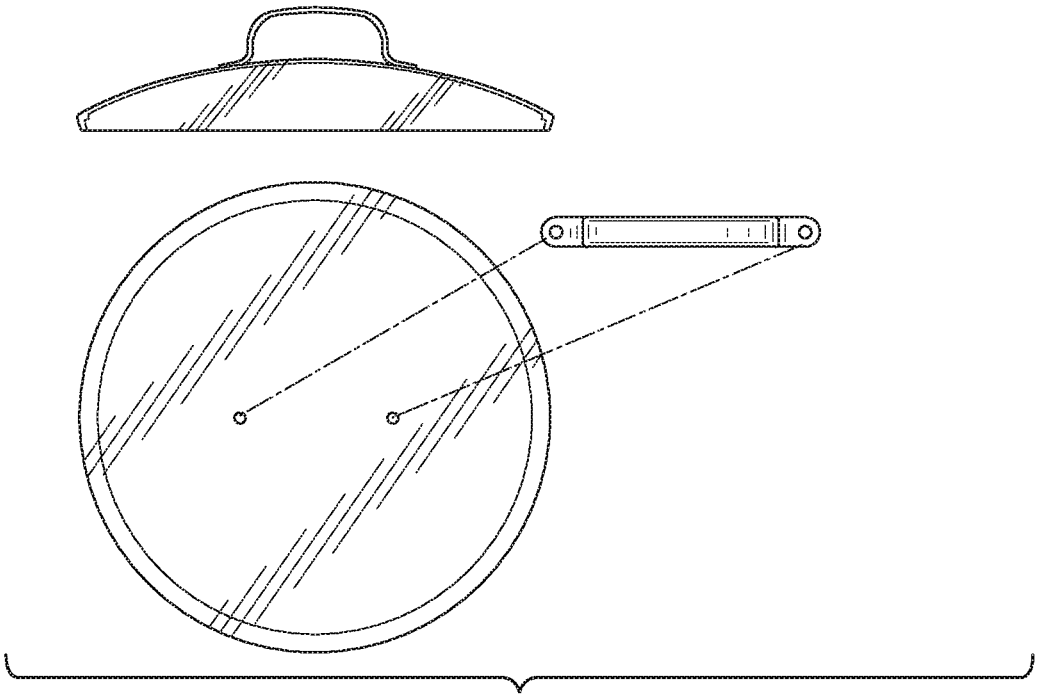
FIG. 10C depicts an exemplary embodiment of exemplary top and side views of an exemplary pot lid with exemplary handle.

FIG. 10C depicts an exemplary embodiment of exemplary top and side views of an exemplary pot lid with exemplary handle.

Figure 10D:
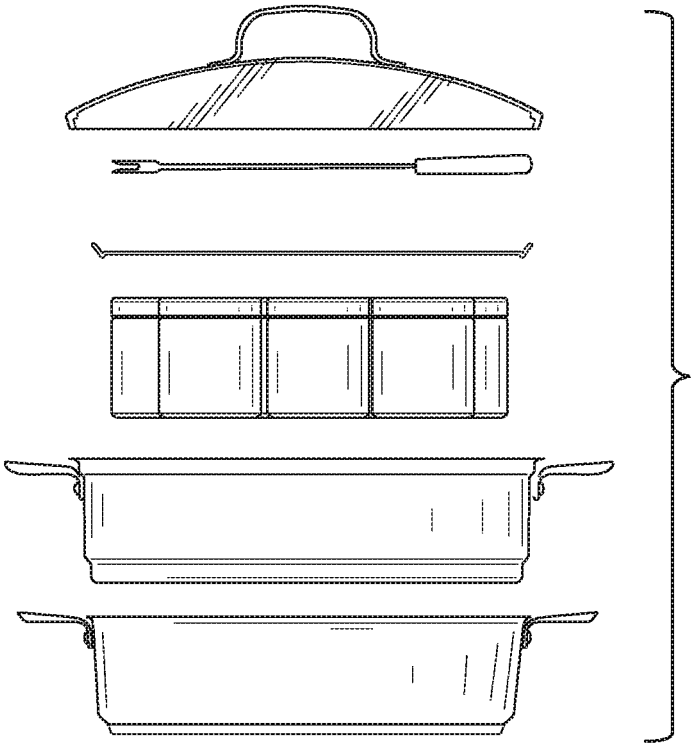
FIG. 10D depicts an exemplary embodiment of an exemplary exploded side view of an exemplary pot, steamer portion, yogurt jar(s), an exemplary fondue plate; an exemplary fondue fork, and an exemplary lid.

FIG. 10D depicts an exemplary embodiment of an exemplary exploded side view of an exemplary pot, steamer portion, yogurt jar(s), an exemplary fondue plate; an exemplary fondue fork, and an exemplary lid.

Figure 10E:
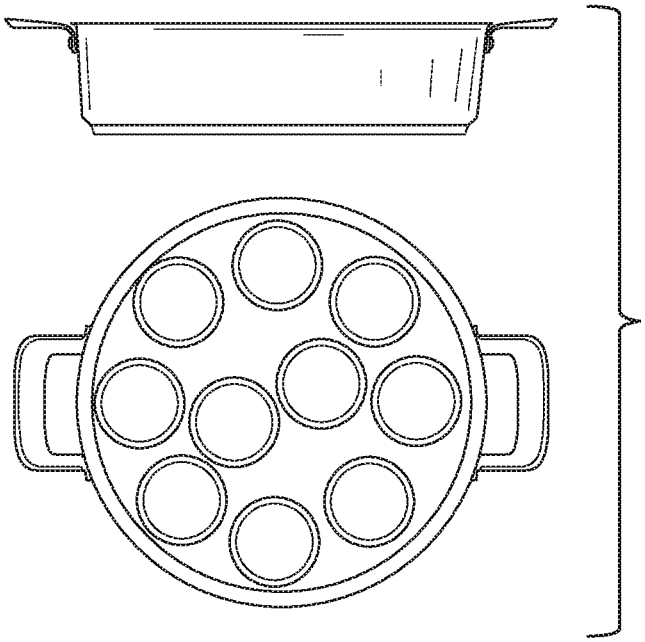
FIG. 10E depicts an exemplary side view and exemplary top view, and isometric view of an exemplary yogurt pot holding a number of exemplary yogurt jars.

FIG. 10E depicts an exemplary side view and exemplary top view, and isometric view of an exemplary yogurt pot holding a number of exemplary yogurt jars.

Figure 10F:
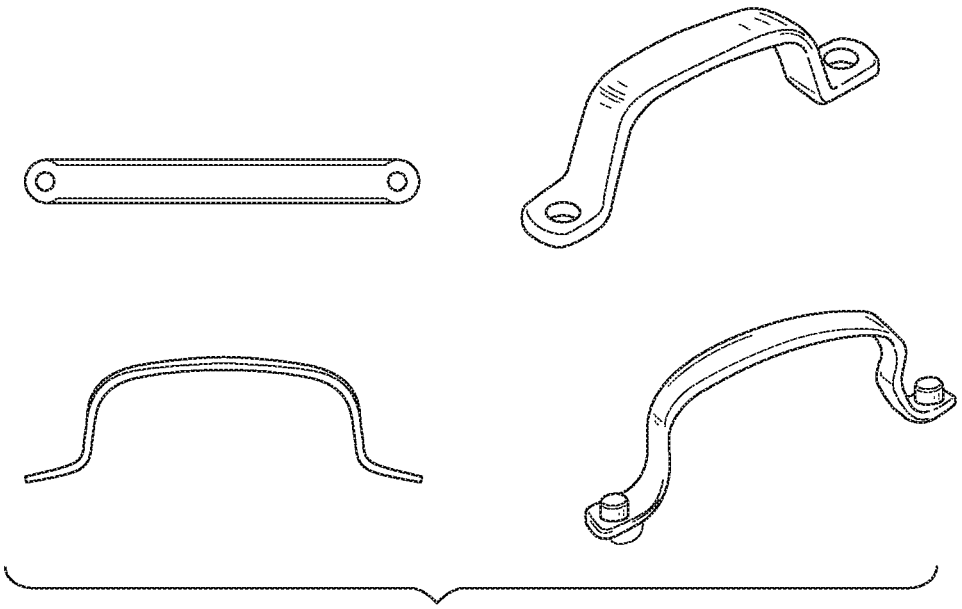
FIG. 10F depicts an exemplary side view and exemplary top view of an exemplary pot lid handle; according to an exemplary embodiment.

FIG. 10F depicts an exemplary side view and exemplary top view of an exemplary pot lid handle; according to an exemplary embodiment.

Figure 10G:
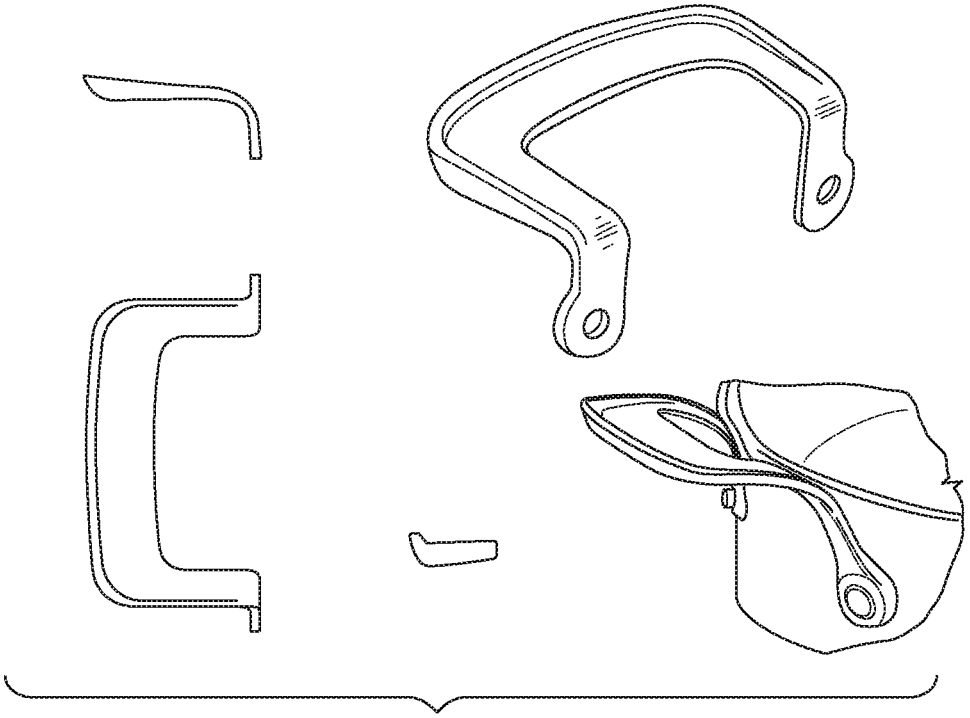
FIG. 10G depicts an exemplary side view and exemplary top view of an exemplary pot lid handle, according to an exemplary embodiment.

FIG. 10G depicts an exemplary side view and exemplary top view of an exemplary pot lid handle, according to an exemplary embodiment.

FIGS. 11A1, 11A2 and 11A3 (collectively, "FIG. 11A") depict an exemplary embodiment of an exemplary pressure popcorn maker and an exemplary popcorn container in an exemplary semi-transparent isometric view 1104, an exemplary top view 1102 and an exemplary side or front view 1100 illustrating an exemplary embodiment of the exemplary popcorn maker and container adapted to be used with or sold as a kit with an exemplary embodiment of an exemplary countertop cooktop, including various exemplary but non-limiting dimensions, according to an exemplary embodiment of the present invention.

Figure 11:
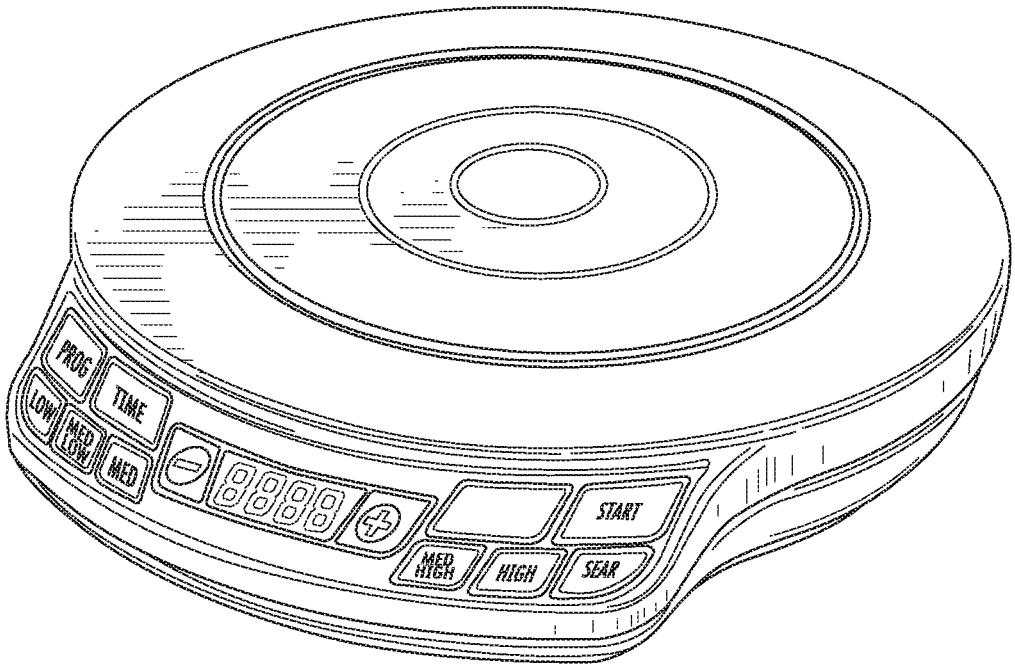

FIGS. 11B1 and 11B2 (collectively, "FIG. 11B), depict an exemplary embodiment of an exemplary pressure popcorn maker including an exemplary top view 1120 and an exemplary side or front view 1110, respectively illustrating an exemplary embodiment of the exemplary popcorn maker adapted to be used with or sold as a kit with an exemplary embodiment of an exemplary countertop cooktop, including various exemplary but non-limiting dimensions, according to an exemplary embodiment of the present invention.

Figure 11C:
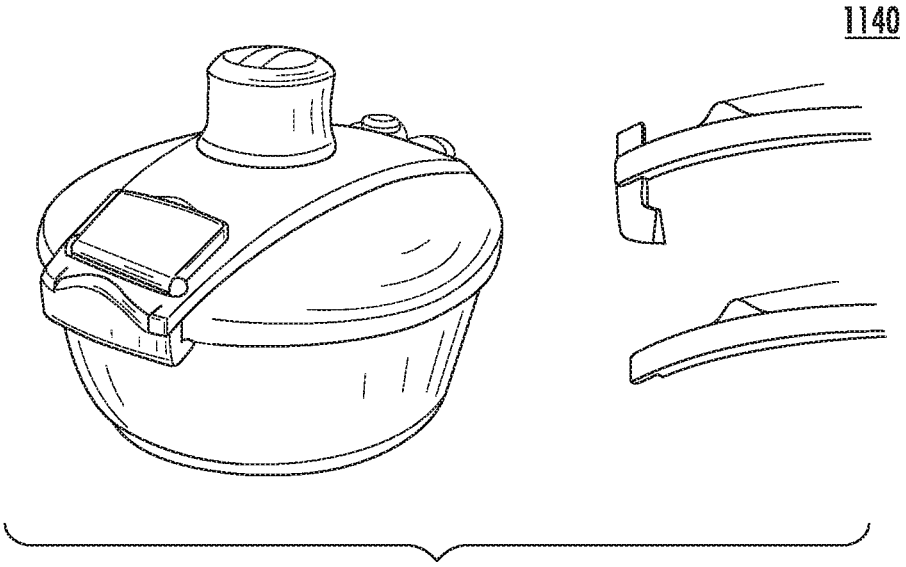
FIG. 11C depicts an exemplary embodiment of an exemplary steam pot illustrating an exemplary spring loaded locking system including exemplary push and lock mechanism and exemplary hidden hinges including an exemplary top view and an exemplary side view illustrating an exemplary embodiment of the exemplary popcorn maker adapted to be used with or sold as a kit with an exemplary embodiment of an exemplary countertop cooktop, including various exemplary but non-limiting dimensions, according to an exemplary embodiment of the present invention.

FIG. 11C depicts an exemplary embodiment of an exemplary steam pot illustrating an exemplary spring loaded locking system including exemplary push and lock mechanism and exemplary hidden hinges including an exemplary top view and an exemplary side view illustrating an exemplary embodiment of the exemplary popcorn maker adapted to be used with or sold as a kit with an exemplary embodiment of an exemplary countertop cooktop, including various exemplary but non-limiting dimensions, according to an exemplary embodiment of the present invention.

Figure 11D:
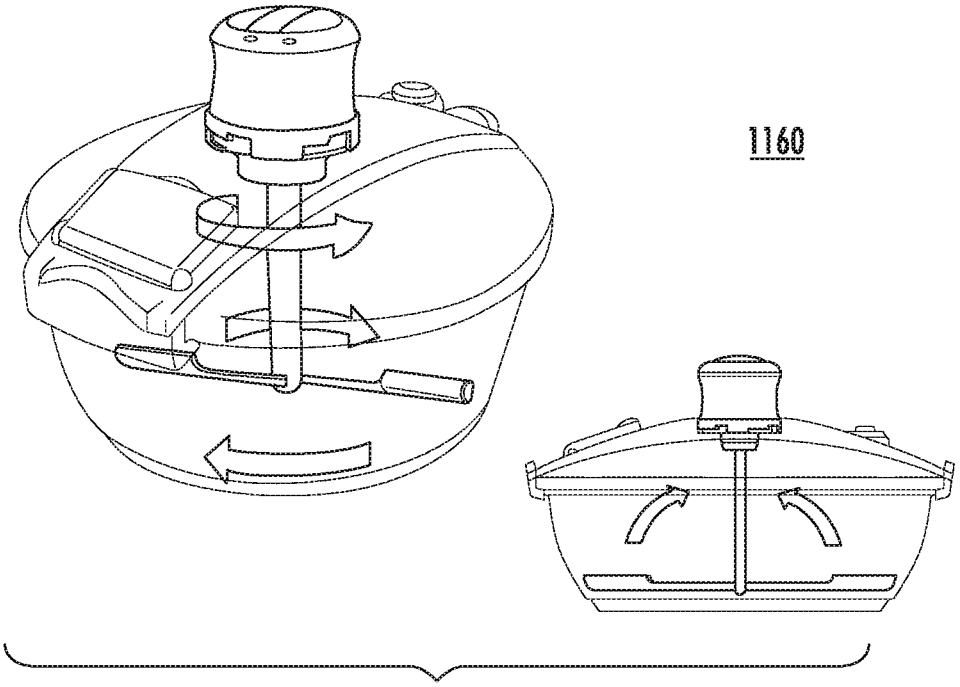
FIG. 11D depicts an exemplary embodiment of an exemplary steam pot illustrating an exemplary hands-free stirring system and exemplary two-way speed control knob, exemplary push and rotate auto-stir device and exemplary position lock, and an exemplary folding stirring spoon exemplary side view of an exemplary embodiment of the exemplary pressure popcorn maker adapted to be used with or sold as a kit with an exemplary embodiment of an exemplary countertop cooktop, according to an exemplary embodiment of the present invention.

FIG. 11D depicts an exemplary embodiment of an exemplary steam pot illustrating an exemplary hands-free stirring system and exemplary two-way speed control knob, exemplary push and rotate auto-stir device and exemplary position lock, and an exemplary folding stirring spoon exemplary side view of an exemplary embodiment of the exemplary pressure popcorn maker adapted to be used with or sold as a kit with an exemplary embodiment of an exemplary countertop cooktop, according to an exemplary embodiment of the present invention.

Figure 11E:
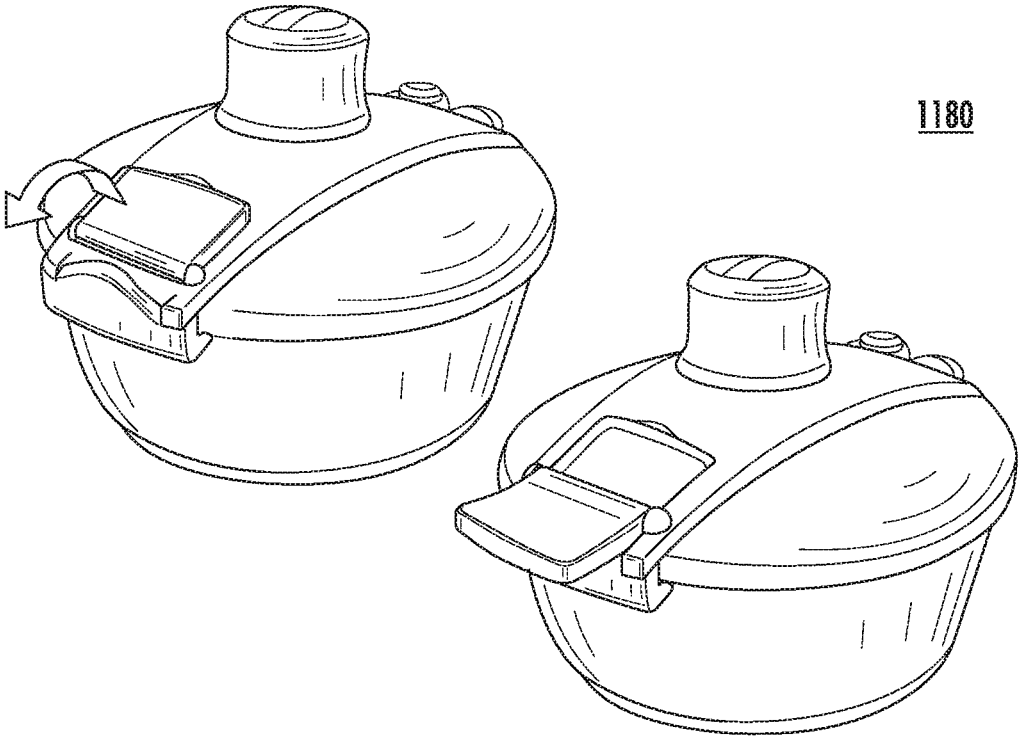
FIG. 11E depicts an exemplary embodiment of an exemplary steam pot illustrating an exemplary pressured popcorn popper door and exemplary spring loaded lid-locking system, exemplary hands-free automatic stirring system, exemplary pressure lid, exemplary pressure pot, exemplary door set to pressure release in an exemplary embodiment, formed out of exemplary heat resistant plastic in an exemplary embodiment, illustrating an exemplary embodiment of the exemplary popcorn maker adapted to be used with or sold as a kit with an exemplary embodiment of an exemplary countertop cooktop, including various exemplary but non-limiting dimensions, according to an exemplary embodiment of the present invention.

FIG. 11E depicts an exemplary embodiment of an exemplary steam pot illustrating an exemplary pressured popcorn popper door and exemplary spring loaded lid-locking system, exemplary hands-free automatic stirring system, exemplary pressure lid, exemplary pressure pot, exemplary door set to pressure release in an exemplary embodiment, formed out of exemplary heat resistant plastic in an exemplary embodiment, illustrating an exemplary embodiment of the exemplary popcorn maker adapted to be used with or sold as a kit with an exemplary embodiment of an exemplary countertop cooktop, including various exemplary but non-limiting dimensions, according to an exemplary embodiment of the present invention.

Figure 11F:
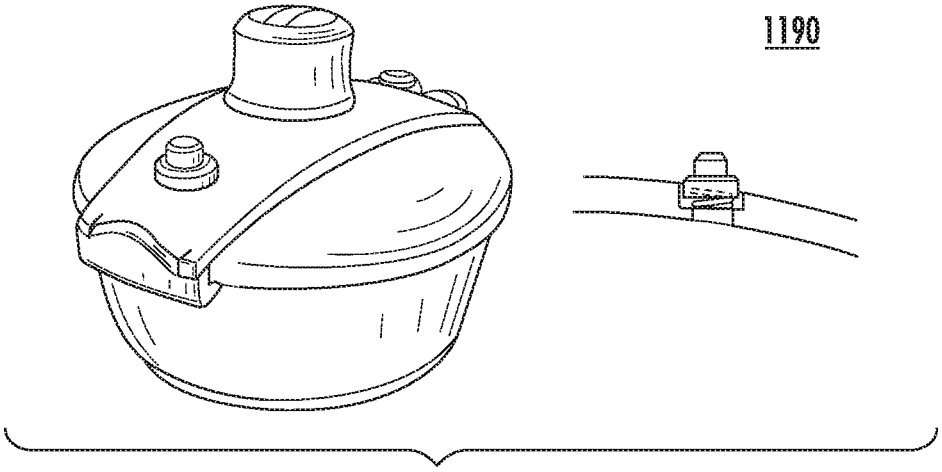
FIG. 11F depicts an exemplary embodiment of an exemplary two-way safety system comprising an exemplary primary spring-loaded valve, and an exemplary secondary spring-loaded valve of an exemplary steam pot illustrating an exemplary top and cross-sectional cut-away view of an exemplary embodiment of the exemplary popcorn maker adapted to be used with or sold as a kit with an exemplary embodiment of an exemplary countertop cooktop, including various exemplary but non-limiting dimensions, according to an exemplary embodiment of the present invention.

FIG. 11F depicts an exemplary embodiment of an exemplary two-way safety system comprising an exemplary primary spring-loaded valve, and an exemplary secondary spring-loaded valve of an exemplary steam pot illustrating an exemplary top and cross-sectional cut-away view of an exemplary embodiment of the exemplary popcorn maker adapted to be used with or sold as a kit with an exemplary embodiment of an exemplary countertop cooktop, including various exemplary but non-limiting dimensions, according to an exemplary embodiment of the present invention.

Figure 12A:
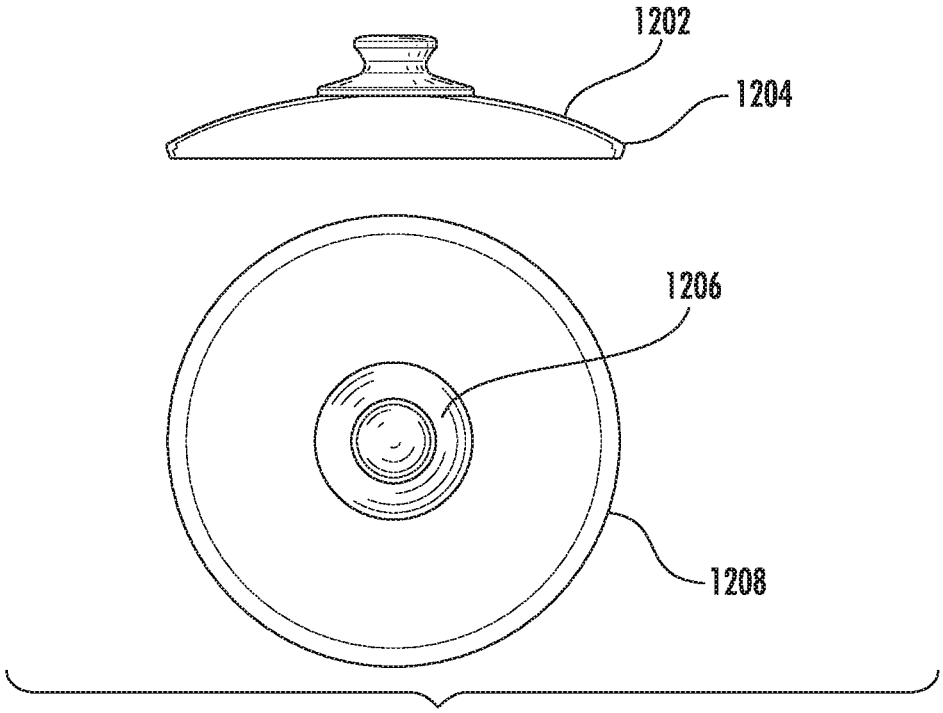
FIGS. 12A-12F depict various exemplary pots, pans, lids and other accessories with various exemplary handles and shapes.
Figure 12B:
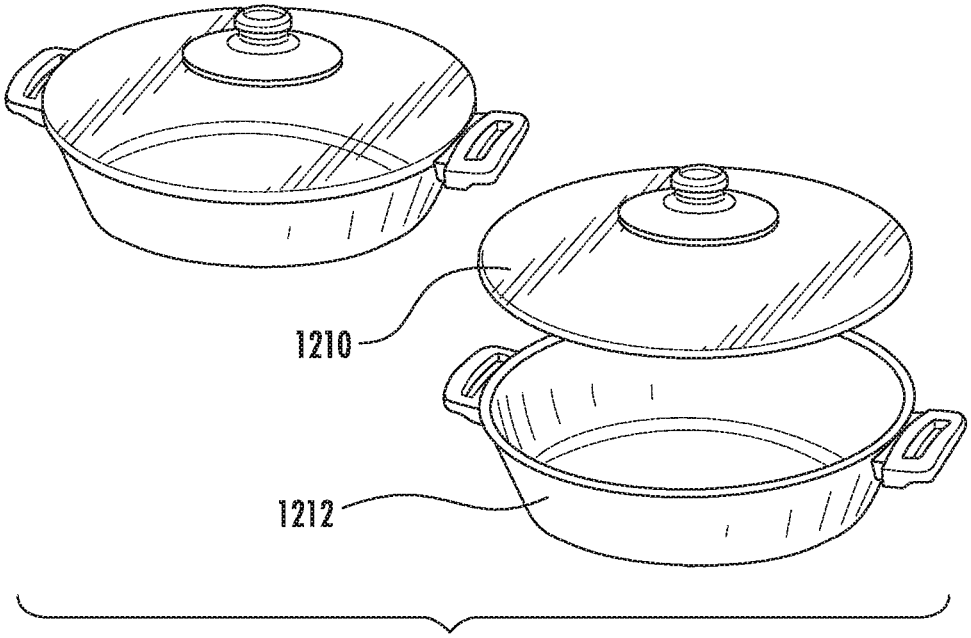
Figure 12C:
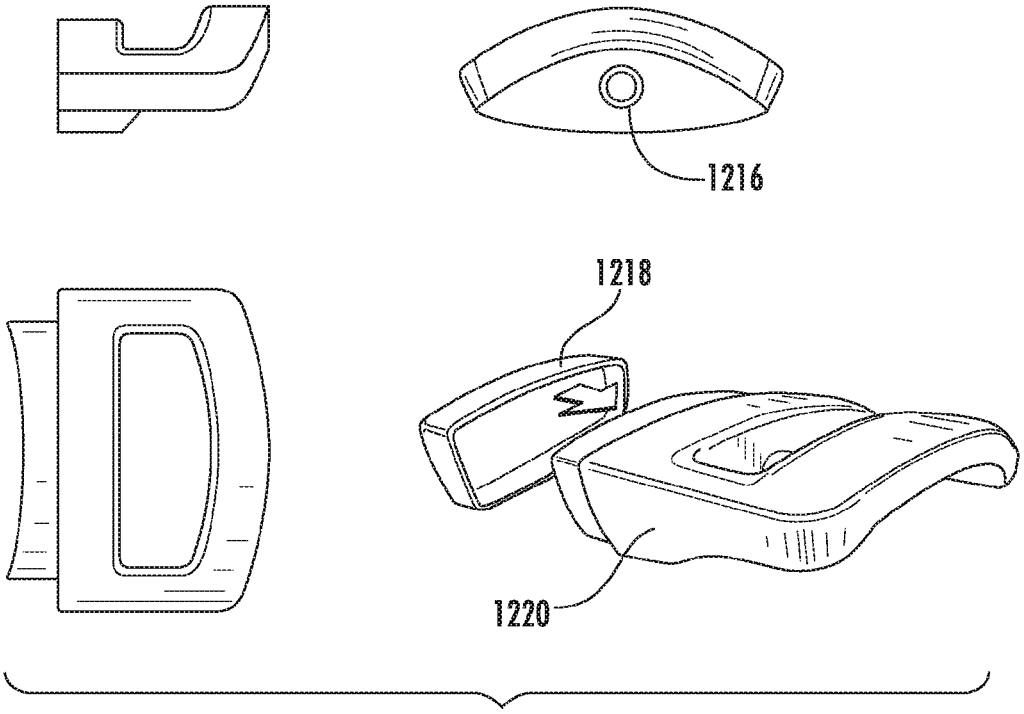
Figure 12D:
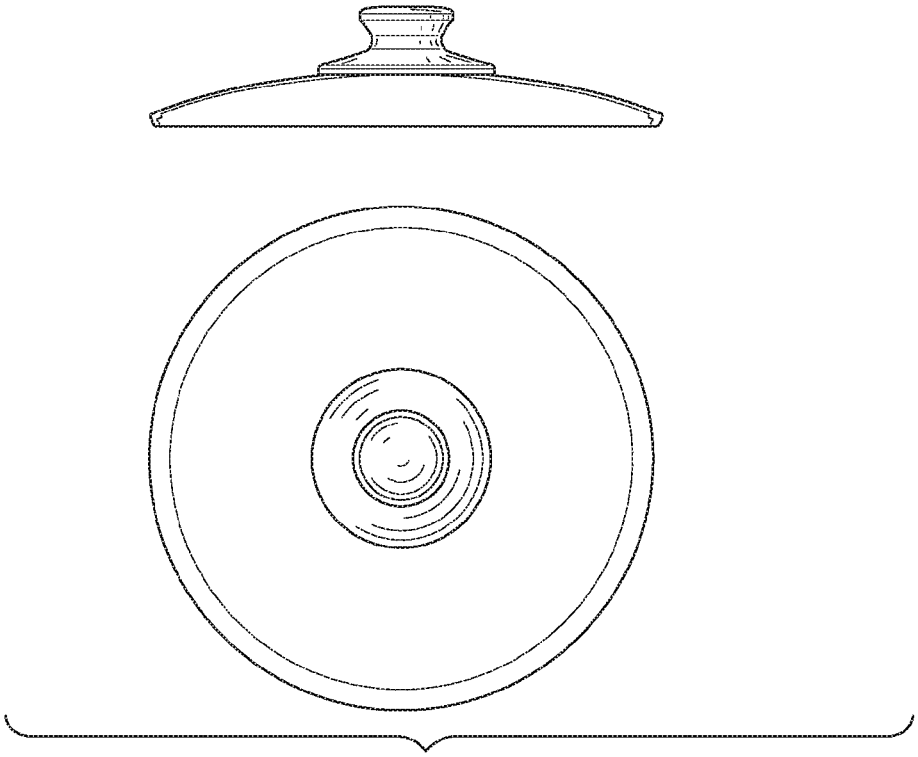
Figure 12E:
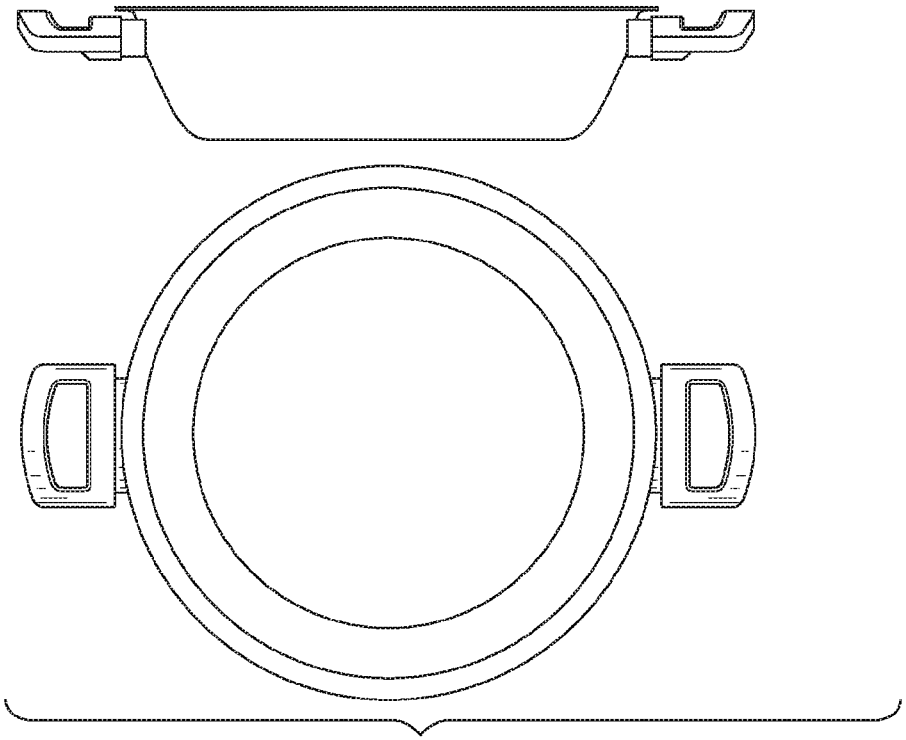
Figure 12F:
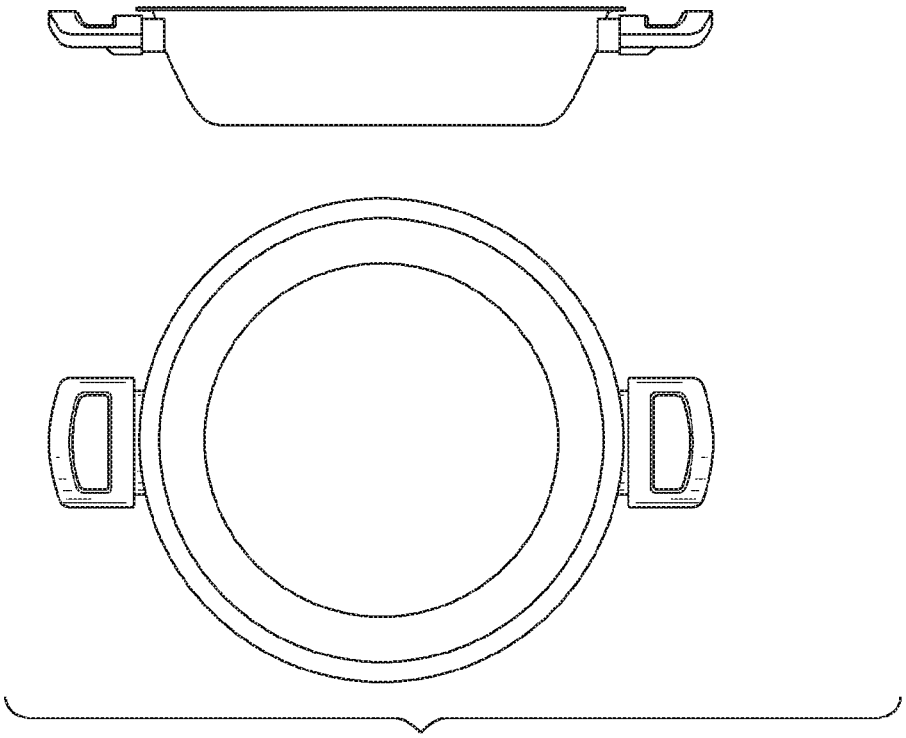

FIGS. 12A-12F depict various exemplary pots, pans, lids and other accessories with various exemplary handles and shapes. Various exemplary designs include various exemplary, but non-limiting handle designs, shapes, pan colors, etc. FIG. 12A depicts a side and top view of an exemplary pot lid including glass 1202, stainless steel 1204, a plastic lid handle 1206, and an example diameter 1208, in one embodiment. FIG. 12B depicts a pot with glass lid including lid 1210 and pot 1212, in one embodiment. FIG. 12C depicts a pot handle including hole 1216 for a screw, stainless steel 1218, and charcoal gray plastic handle 1220, in one embodiment. FIG. 12D depicts a top and side view of an exemplary pot lid, in one embodiment.

Figure 13:
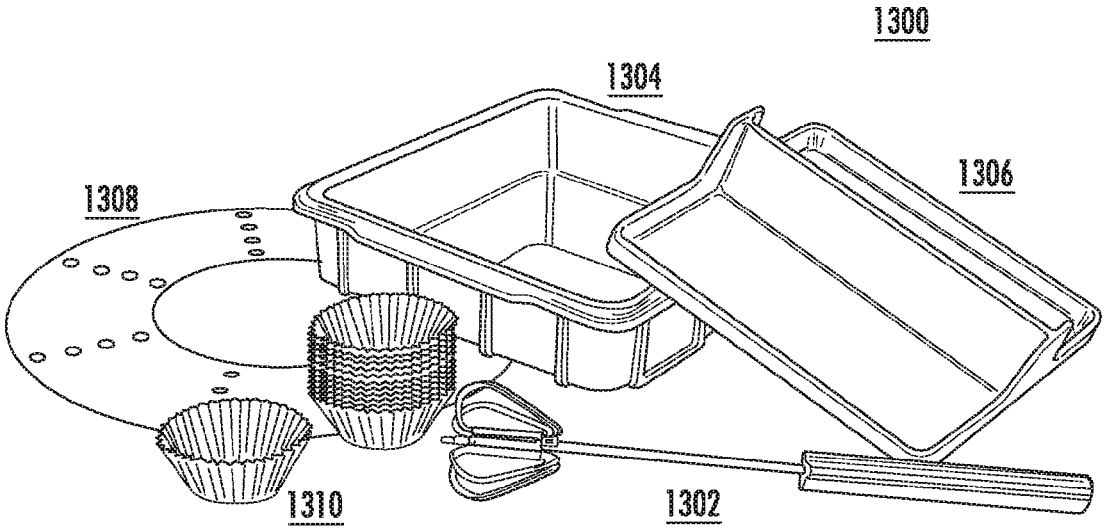
FIG. 13 depicts an exemplary embodiment of an exemplary silicone baking kit, which may be sold as a kit according to another exemplary embodiment, as may be used in an exemplary NuWave Oven or in preparation of food for conventional ovens, according to an exemplary embodiment.

FIG. 13 depicts an exemplary image of an exemplary kit 1300 of an exemplary baking kit as may be offered as a standalone kit, or as a kit bundled with another device such as, e.g., but not limited to, a NuWave Oven, available from Hearthware Inc. of Libertyville, Ill., USA. The kit 1300 of an exemplary embodiment of an exemplary silicone baking kit, which may be sold as a kit according to another exemplary embodiment, as may be used in an exemplary NuWave Oven or in preparation of food for conventional ovens, according to an exemplary embodiment.

The exemplary silicone baking kit 1300 as illustrated may include, in an exemplary embodiment, a handheld auto spinning whisk 1302, which may operate by an exemplary two opposing screws so as to make the whisk portion spin when the handle portion is moved along its length directionally, according to an exemplary embodiment.

According to an exemplary embodiment, the exemplary baking kit 1300 may include an exemplary silicon baking pan 1304. According to an exemplary embodiment, the exemplary baking kit 1300 may include an exemplary silicone cake pan divider 1306, which may, in an exemplary embodiment, be used to cook two separate cakes at the same time, e.g., a chocolate cake and a vanilla cake, and may advantageously be used to lift the cake out of the accompanying pan, in this case, the exemplary silicon baking pan 1304, according to an exemplary embodiment. The exemplary baking pan 1304 may be constructed of any conventional blow molded food grade materials as set forth in, e.g., but not limited to, U.S. Pat. No. 7,862,318, US 2007/0267374, and US 2007/0284505, the contents of both of which are incorporated herein by reference in their entireties. Advantageously, the divider according to an exemplary embodiment may prevent the dough from the first side from mixing with dough in the second side. The material of the divider could include a metallic or strengthening material, however, it is desirable in an exemplary embodiment to use silicone materials to prevent the possibility of burning. According to exemplary embodiments, the divider may include one or more dividing inserts, which may include one or more silicone ribs about the perimeter of each divided portion, including a closed bottom to enable lifting of the baked goods out of the pan. An exemplary embodiment is designed to allow for baking multiple types of dough at one time, in discrete, divided exemplary portions of the pan.

The exemplary silicone baking kit 1300 as illustrated may include, in an exemplary embodiment, an annular cylindrical ring 1308, adapted with exemplary holes for convection heating, as shown. In an exemplary embodiment, the annular ring 1308 may be adapted to be placed on an oven surface, such as, e.g., but not limited to a metal shelf or grill, and may be adapted to support other silicone baking containers such as, e.g., but not limited to, cookie or cupcake silicone cup containers 1310, or the like. The silicone cup cake containers may be constructed as illustrated in U.S. Pat. No. 6,905,017, or US 2005/0211101, the contents of both of which are incorporated herein by reference in their entireties.

Figure 14A:
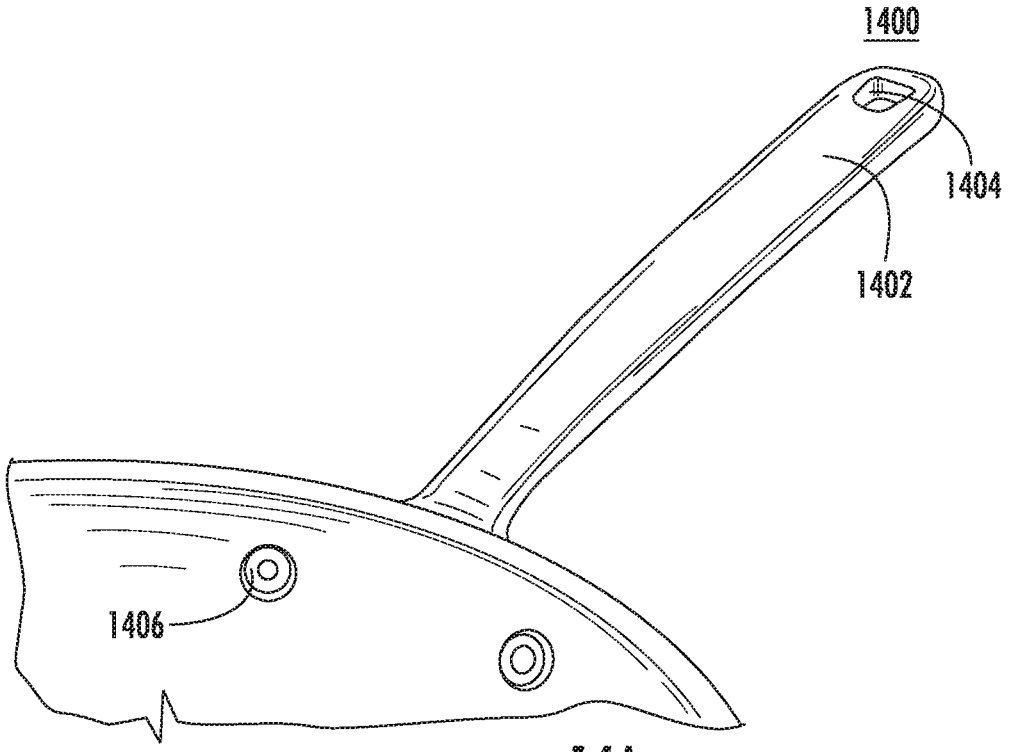
FIG. 14A depicts an exemplary embodiment of an exemplary green colored inner surface, stainless steel pan with exemplary stainless steel handle, and exemplary handle indentation adapted to allow convenient stacking of multiple stainless steel handled pans including an exemplary handle having a hole for hanging, and exemplary coupling mechanism to the exemplary pan such as, e.g., but not limited to, exemplary rivets, according to an exemplary embodiment.

FIG. 14A depicts a diagram 1400 illustrating an exemplary handle of an exemplary embodiment of an exemplary green colored inner surface, stainless steel pan. In an exemplary embodiment, the exemplary stainless steel handle may include an exemplary handle indentation 1402 adapted to allow convenient stacking of multiple stainless steel handled pans, as well as an exemplary hole 1404 in the handle for, e.g. but not limited to hanging, and an exemplary coupling mechanism for coupling the exemplary stainless steel handle to the exemplary pan such as, e.g., but not limited to, exemplary rivets 1406, according to an exemplary embodiment. As shown, an exemplary distinctive green ceramic coloring may be placed in the inner portion of the exemplary stainless steel pan.

Figure 14B:
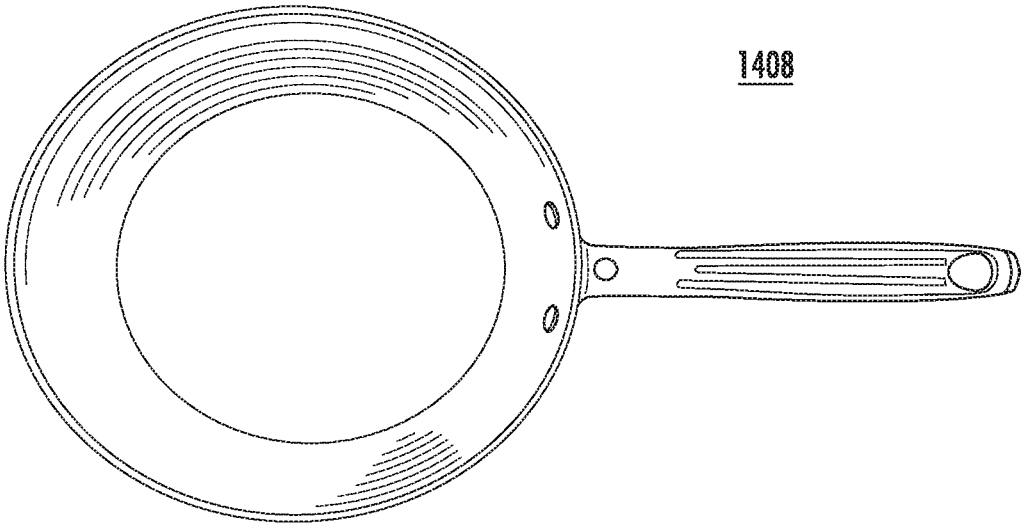
FIG. 14B depicts an exemplary embodiment of an exemplary top view of an exemplary pan according to an exemplary embodiment.

FIG. 14B depicts an exemplary embodiment of an exemplary top view 1408 of an exemplary pan according to an exemplary embodiment.

Figure 14C:
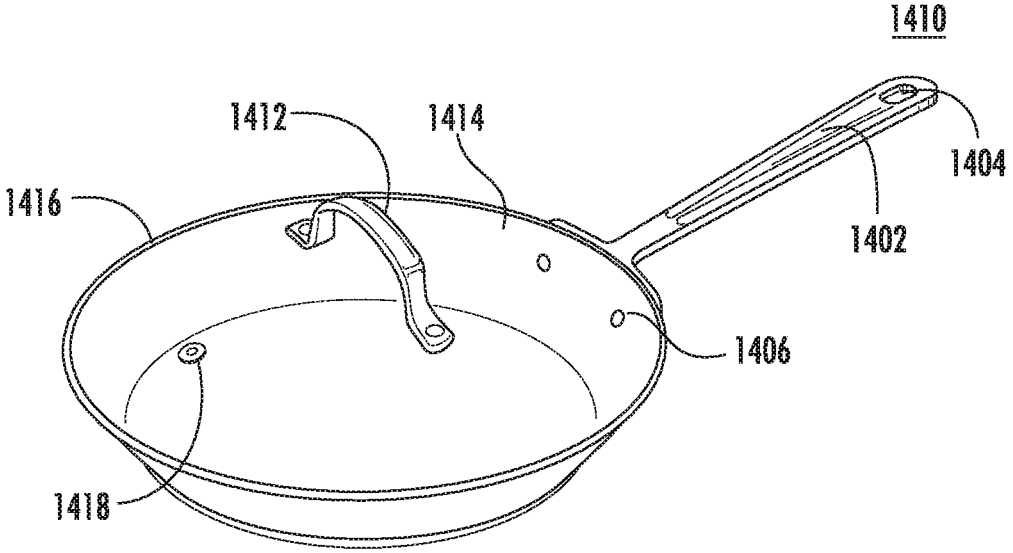
FIG. 14C depicts an exemplary embodiment of an exemplary pan including an exemplary glass cover, with an exemplary handle, an exemplary hole, and exemplary stainless steel rim, according to an exemplary embodiment.

FIG. 14C depicts an exemplary image 1410 illustrating an exemplary embodiment of an exemplary pan with exemplary rivets 1406 coupling an exemplary handle to the pan, the handle having an exemplary indentation 1402, an exemplary hole 1404, and as shown covered with exemplary glass cover 1414, with exemplary stainless steel rim 1416, exemplary handle 1412 and exemplary hole 1418 in the exemplary glass cover, according to an exemplary embodiment.

Figure 14D:
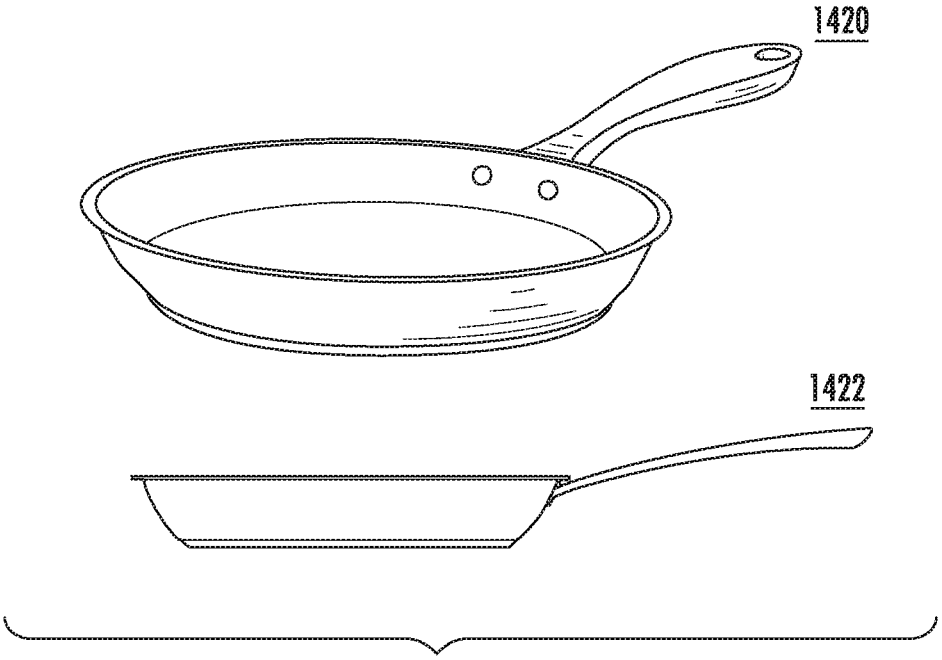
FIG. 14D depicts an exemplary line drawing of an exemplary pan including an exemplary one or more rivets, exemplary green coating inner surface, exemplary shiny stainless steel outer pan, exemplary double folded stainless steel end of edge, and exemplary stainless steel handle, in an exemplary isometric perspective view and an exemplary orthogonal side view, according to an exemplary embodiment.

FIG. 14D depicts an exemplary line drawing 1420 of an exemplary pan including an exemplary one or more rivets, exemplary green coating inner surface, exemplary shiny stainless steel outer pan, exemplary double folded stainless steel end of edge, and exemplary stainless steel handle, in an exemplary isometric perspective view 1420 and an exemplary orthogonal side view 1422, depicting an exemplary double folded stainless steel end of edge, and side view of handle, according to an exemplary embodiment.

Figure 14E:
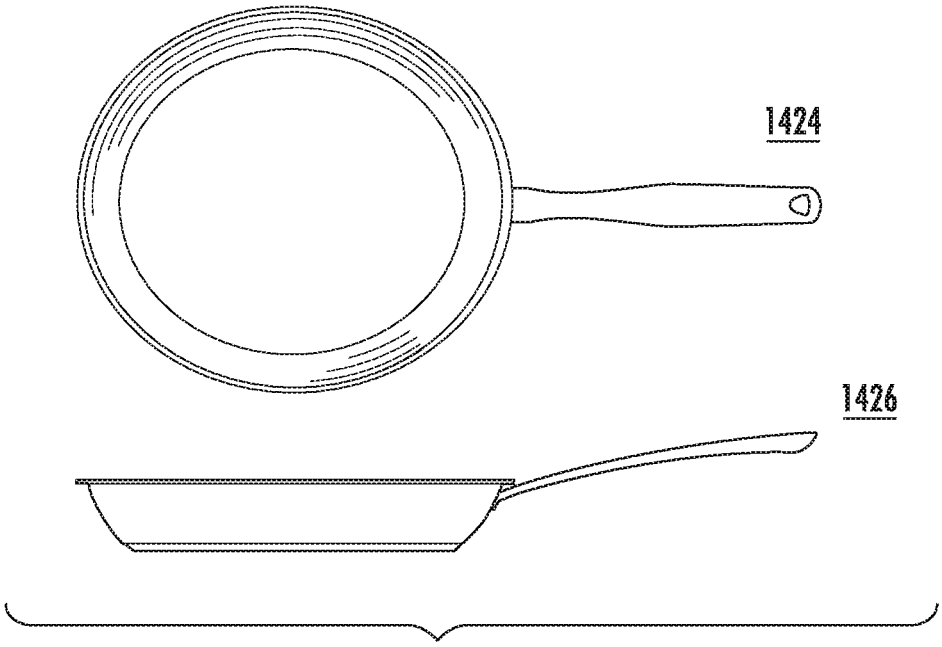
FIG. 14E depicts an exemplary line drawing of an exemplary orthogonal top view and orthogonal side view of an exemplary pan and handle of FIGS. 14A-D, illustrating exemplary, but nonlimiting, dimensions of an exemplary pan, according to an exemplary embodiment.

FIG. 14E depicts exemplary line drawings illustrating an exemplary orthogonal top view 1424 and orthogonal side view 1426 of an exemplary pan and handle of FIGS. 14A-D, illustrating exemplary, but nonlimiting, dimensions of an exemplary pan, according to an exemplary embodiment.

Figure 14F:
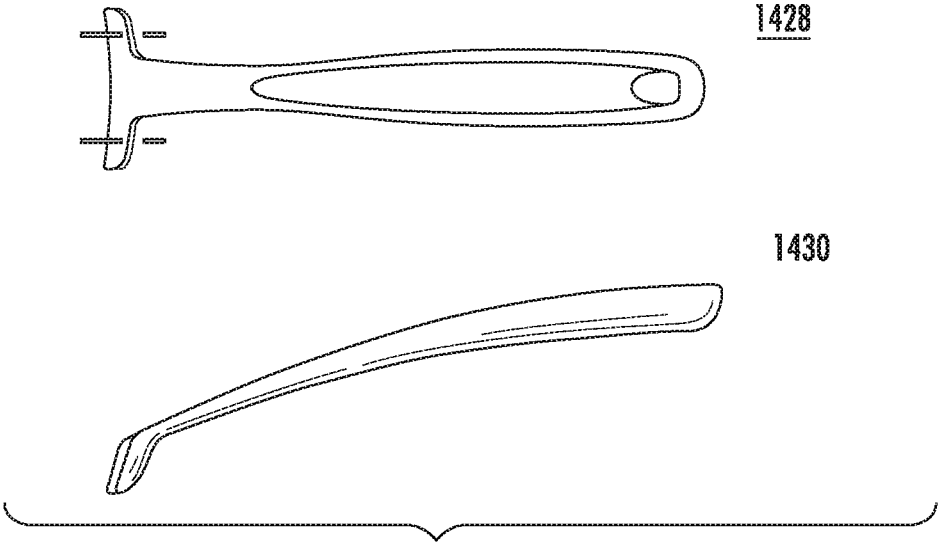
FIG. 14F depicts an exemplary line drawing of an exemplary orthogonal top view and an orthogonal side view of an exemplary pan handle of the exemplary pan of FIGS. 14A-E, illustrating exemplary, but nonlimiting dimensions of an exemplary pan, according to an exemplary embodiment.

FIG. 14F depicts an exemplary line drawing of an exemplary orthogonal top view 1428 and an orthogonal side view 1430 of an exemplary pan handle of the exemplary pan of FIGS. 14A-E, illustrating exemplary, but nonlimiting dimensions of an exemplary pan, according to an exemplary embodiment.

First Section:

Electrical Specifications and Electromagnetic Compatibility Requirements

No. 1 Electrical Specifications:

Product application voltage and frequency: 120 VAC/60 HZ

Rating Power: 1300 W

Application voltage range: 85-144 VAC

Caution: Improper use of wrong voltage could cause certain damage to electrical panel Pots Compatibility: 430 single-sided pot; 430 double-sided pot; 304 single-sided Second Section:

Function Description

A. Exemplary Functional Details:

About Button Pressing and Displaying (1) Stand-by Mode:

Once power is connected, buzzer will beep once (lasting 1 second), all the lights, indicators and digital tubes will be flashing for 1 second; under this condition, the induction cooker is in stand-by mode (digital tubes will be displaying: "0")

(2) Working Mode:

While induction cooker is standing-by, pressing either temperature or time to start functional data input, then START button to make it start functioning; the temperature setting is default as HIGH temperature, digital tube displaying: 450° F. temperature indicator LED5 is on.

TABLE I

| | | | | |
|---|---|---|---|---|
| Default | Time | Temp | | Start |
| | Temp | Time(02:00) | | Start |
| | Time(00:10) | — | Default as HIGH Temp | Start |
| | — | Temperature | | Start as 00:45 |
| | — | — | Start as: | HIGH + 00:45 |

Default display is temperature, pressing TIME shows time, by pressing TIME one more time, timing can be changed; pressing temperature button more than 2 seconds, temperature level will be corrected to the current one.

Cooker will be start working once pot is detected, without any pot, no heat will be created; but E1 will be displayed on the screen, buzzer will beep every 2 seconds, and it will keep detecting pot, if no pot has been detected after 1 minute, then induction cooker will be shut off automatically.

In addition: time can be changed as well as temperature.

By any time during operation pressing CANCEL, then task is finished.

Both party agreed there will be a START button and a Cancel/Pause button.

Exemplary Starting Instructions

Easy Start:

Precision is preset to cook at High (425° F.) for 2 hours. To start cooking, press "Start" button, make sure the pot is on the surface. If cooking at any other power level other than "High", you would need to press "Low" to "Max/Sear" or press the "−" or "+" to increase or decrease temperature in 10° F. increments. See the Panel Display Chart in the FIG. 1K.

Control Panel on Display Panel:

"0" should appear when the program is clear or power is on.

When You Start Cooking:

Set your temperature and time, then press "Start" to begin cooking. The oven will automatically stop cooking when the time has expired and will beep to alert you that it has stopped. The display will always show the temperature during the cooking cycle. If you wish to see the time count down, press "Time" and the time will show until the cycle or stage is complete.

Setting Temperature:

This appliance is preset to cook at High (425° F.). To set the temperature, press temperature key "Low"—"Max/Sear", then press "Start".

The temperature range will show on the display panel. To raise or lower the temperature, press the "+" button or "−" until desired temperature is shown in display panel. Refer to chart below for preset temperatures.

The minimum temperature, in an exemplary embodiment, is 100° F. and the maximum temperature ranges around 575° F. The "+" and "−" will increase or decrease the temperature in exemplary 10° F. increments.

(3) Digital Tubes and Indicators Displaying Instruction:

Digital tubes showing temperature 100° F.-575° F. and time setting;

No. 1 Temperature setting is divided into 49 options: From 100° F. to 590° F., each 10° F. is one unit (Temperature sensor range can only reach to 250° C./482° F.).

TABLE II

| | | | | |
|---|---|---|---|---|
| 100° F.-170° F. | 400 W | LOW | Between LED 1 + 2 | 100° F. LED: 1 |
| 180° F.-270° F. | 600 W | MED. LOW | Between LED 2 + 3 | 175° F. LED: 2 |
| 280° F.-370° F. | 800 W | MED | Between LED 3 + 4 | 275° F. LED: 3 |
| 380° F.-450° F. | 1000 W | MED. HIGH | Between LED 4 + 5 | 375° F. LED: 4 |
| 460° F.-570° F. | 1200 W | HIGH | Between LED 5 + 6 | 455° F. LED: 5 |
| 580° F. | 1350 W | SEAR | LED 6 | 575° F. LED: 6 |

Temperature Display: First time touch will display default figure, if last digit is '5' numbered, while there is no 5 unit in the list, then by pressing '+' or '−' cannot be showing any 5 unit, rather each unit is set as 10.

No. 2 Time displaying range: 99 hours and 99 minutes.

(4) Button Pressing Description

The 11 Buttons are: PROG, TIME, START, DEC, INC, LOW, MED LOW, MED, MED.HIGH, HIGH and SEAR a) Temperature Selection: by selecting different power options during operation, related temperature range will also be selected.

b) '+' button: Under Timing/Temperature mode, each time pressing '+' button will add 1/10 minutes/hour; Temperature will be add by one unit c) '−' button: Under Timing/Temperature mode, each time pressing '−' button will minus 1/10 minutes/hour; Temperature will be minus by one unit.

(5) Function Description a) Mode 1:

Under stand-by mode, press START button, buzzer beep once, fan start working, and default as HIGH power function. LED 5 indicator is on, power rated as 1200 W, digital tube displaying '450 F' Default time is '00:45', induction cooker is entering operation mode.

Press '+' or '−' to change temperature settings, by pressing each time, one power gear will be added or reduced. (Either pressing '+' or '−', buzzer will beep once).

Time appointment is available, press TIME button, time is default as 00:00; First digit 0 from right hand side will start blinking; By pressing the same button each time, digits can be shifted from right to left. Users can press '+' or '−' to adjust the time, and lastly press TIME button again to confirm the timing (Alternatively MCU will automatically lock the set time after 5 seconds). If '00:00 is displayed, that means no appointment has been made, then program will be cancelled after 5 seconds.

When making time appointment, The default is TEMPERATURE display.

By pressing any power buttons, temperature can be shown, and then press '+' or '−', users are able to change the temperature.

When changing time, press the TIME button, digital tube will flash, thus by pressing '+' or '−', users are able to change the time.

By pressing the TIME button during operation, uses are able to see the remaining time.

FIG. 1K, 188 illustrates exemplary temperature ranges and panel displays for each of the exemplary button selections of FIG. 1K, ref. 186, according to one exemplary input/output (I/O) display interface of an exemplary cooktop. An exemplary sear may be set to a maximum temperature of, e.g., but not limited to, approximately 500+° Fahrenheit, for an exemplary user selectable time period, e.g., up to 5 minutes, selected by selecting time, and then pressing the increment values.

In an exemplary embodiment, the induction cooktop may shutoff after a set time such as, e.g., but not limited to, 2 hours, or 60 seconds after pressing pause/clear, or after displaying E1 noting, e.g., that a pot is not secure, or the pot is incompatible with the cooktop, etc. Pressing the time button multiple times may be used to change in increments of 10s of minutes, or hours, etc.

When cleaning, of course one should be discouraged from ever immersing the unit, and the unit should be unplugged.

In an exemplary embodiment, a cooking club may be provided including online access to one or more recipes, videos, live chat, discussion groups, social networking platform, exclusive recipes, etc. According to an exemplary embodiment, downloadable features may be accessed online, such as, e.g., but not limited to, recipes, electronically storable programming instructions, etc.

b) Mode 2: Program Mode

Under stand-by condition, pressing PROG button, digital tube displaying: Pro, power has to be set first by pressing any POWER button. Power changing is the same as Mode 1;. Once temperature has been set then press TIME button, and then press '+' or '−' to change the time. At this time, by pressing any POWER button, first stage will be saved and memorized. Therefore entering the second stage, application method is the same as stage one. After stages has been set, then press START button to active those programs Available maximum stage is 10.

If the process has not been saved, then press Cancel button to exist. If it has been saved, then application will follow the saved instruction to start the task.

Example: PROG->POWER->TIME->POWER->TIME->START 2 STAGES

During cooking time and temperature at current stage can be changed by same inputting method, stage can work continuously from one to another (1 to 10)

MCU will follow stage one to start functioning, timing is working in countdown format; When timing task is finished (reach to '0'), buzzer will beep once and induction cooker will back to stand-by mode.

If the digital tube were displaying temperature, and uses want to check time, then press the TIME button, then time display can be obtained.

For Program mode, power has to be set first, then that is the time setting.

In addition, while cooking, always shows temperature.

PROG->Temperature Time->START one stage is saved.

Also PROG->Temperature TIME Temperature TIME Temperature Time->3 stages are saved.

Under program mode, when the stages has been saved, by pressing PROG button one more time, then enter TIME, delayed cooking (Appointment mode) can be obtained.

TIME displaying '00:00', enter relevant time for the delayed cooking time. Maximum timing would be '99:99' After these actions by pressing PROG->TEMPERATURE, that means if the temperature went up significantly during the working stage, overheating E1 will be displayed, once the temperature is back to normal, induction cooker will follow the second temperature to work.

B. Exemplary Protection Function:

Protection Features Include:

1. Passing current protection: when the current loading on the circuit is over, then power will be cut off in order to protect the circuit.

2. Passing voltage protection: when the input voltage is over, then major components will be protected by the resistor(s) from any damages.

3. IGBT over-heating protection: when IGBT temperature is exceeding 110° C., all operation will be stopped and alarm (beeping) will be raised.

4. When electrical waves exist, any operation will be stopped for 2 seconds, heat will be created again after 2 seconds.

5. Heat releasing: Fan will work for another 60 seconds after shut off,

6. No timing is set if no action has been made within 2 hours, then auto shut off.

7. If there is no pot put within 1 minute, then auto shut off.

C. Exemplary Self-Testing Function:

If abnormal condition or error arises on the circuit, it will be detected by the IC and inform users by beeping alert, heat source will be isolated, indicator code showing (see FIG. 1K, reference 190):

| | |
|---|---|
| 1. No Pot/Wrong Pot: | E1 |
| 2. IGBT sensor Open or Short circuit: | E2 |
| 3. Low voltage 85 V: | E3 |
| 4. High voltage 144 V: | E4 |
| 5. NTC short circuit: | E5 |
| 6. NTC open circuit: | E6 |
| 7. IGBT over-heating (e.g., 110° F.) | E7 |
| 8. Overheating (e.g., 20 degrees > sear) | E8 |
| 9. During prog mode when total time reaches limit, no more stages can be entered, e.g., 99:99 | FULL |

When error E2, E5, E6, E7 exists, in an exemplary embodiment, only reconnect the power is able to correct the error (error sign will disappear).

When any error exists, in an exemplary embodiment, then the buzzer will beep once.

When E3 (E4) error exists, if the voltage could be back to normal ranges, I.E minimum voltage +10V (about 95V), maximum voltage −10V (Below 134V), then it will carry on working; otherwise, error sign will keep displaying.

When any of the exemplary messages of FIG. 1K are displayed on the LCD display, according to an exemplary embodiment, the unit may beep at least once.

Fan may run for an additional 60 seconds after one press "Pause/Clear" button once, according one exemplary embodiment. One may continue cooking by pressing the "Start" button within 45 minutes, in an exemplary embodiment.

The unit may turn off after 45 minutes if no buttons (such as "Start") are pressed, according to one exemplary embodiment. When the unit shuts off, it may clear all previous cooking history, according to one exemplary embodiment.

When pressing the "Pause/Clear" button twice, in one exemplary embodiment, the fan may run for an additional 60 seconds. After that, in an exemplary embodiment, the unit may then turn off.

When message E1 occurs/is displayed, in one exemplary embodiment, it may beep, e.g., periodically, such as, e.g., but not limited to, every 2 seconds, until it detects a pot, in an exemplary embodiment. If the unit has not detected a pot after an exemplary period of time, e.g., but not limited to, 1 minute, the unit may then shut off automatically, according to an exemplary embodiment.

To fully correct errors E2, E5, E6, E7 and E8, in an exemplary embodiment, one may need to reconnect the power to have the error sign disappear, according to an exemplary embodiment.

Exemplary Operating Functions

Setting Time:

Press the "Time" button. The "0" will flash in the far right corner of the display panel. Press the "+" button until you reach the desired amount of time. For example; for 5 minutes press "Time" once, then press "+" until you see 00:05 on the display. Next press "Start". For 20 minutes, you press "Time" twice then press the "+" until you see 00:20, then press "Start". For 2 hours and 30 minutes, press "Time" twice, press "+" until you reach 3, then press "Time", press "+" until you reach 2 the display will show 02:30 then press "Start".

Remember the 0 that is blinking would be the digit you can adjust. The maximum time is 99 hours and 59 minutes.

Our display shows hours and minutes, not seconds.

Pause/Clear Function:

To PAUSE the cooking time, press the "Pause/Clear" button one time. This will pause at the particular stage it is in. The temperature will stay in the display panel but the "F" will be blinking. To resume, press "Start".

To CLEAR the cooking mode or display during cooking, press the "Pause/Clear" button twice. The screen will be fully cleared, a "0" will appear and the unit will turn off.

Programming Function (Stage Cooking):

Press the "Prog" button.

"Pro" will be in the display panel.

1. Press the desired set temperatures ranging from "Low" to "Max/Sear". If you need to increase or decrease the temperature press the "−" or "+" buttons.

2. Press the "Time" button 00:00 will be on the display and press the "−" or "+" buttons until you reach the desired time. See above on "SETTING TIME" for detailed information on how to enter minutes and hours.

To add additional stages, repeat steps 1 and 2 and then press "Start" to start your program. You can program up to 10 stages (delay is considered as one stage).

If you need to change any part of the program press "Pause/Clear" button twice and start over.

For example, if you want to boil for 5 minutes then reduce to simmer for 20 minutes; Press "Prog", next press the "Max/Sear" button, press "Time" button once, press "+" until you reach 5. Press "Low" next press "Time" twice then "+" until you reach 20 then press "Start".

NOTE: Maximum allowed cook time is 99 hours and 59 minutes.

Delay Function:

The purpose of this function is for you to be able to have the program you set above start at a later time.

To use this function, press "Prog", then press the "Time" button. The "0" will flash in the lower right corner of the display panel. Press the "+" button until you reach the desired amount of time you wish to delay the oven to start. (For more information, review SETTING TIME on the top of this page). Then press "Prog" again to set cooking program. The amount of time you set for Delay is included in the stages you program. To continue to the next stage, press "Low" to "Max/Sear" indicating which temperature you want to have to start cooking. Continue with #2 on "PROGRAMMING FUNCTION". Once you are ready for the countdown to begin press "Start".

When delay countdown reaches "0", the oven may, in an exemplary embodiment, beep twice to signal the end.

After this the cooking time may start and the temperature may be displayed, in an exemplary embodiment.

Please note that all the above operating instructions are intended as exemplary in nature, and nonlimiting, and are not required, but rather examples of an exemplary operating environment of an exemplary implementation.

Various Exemplary Features of Exemplary Embodiments

A. Programmable Cooking Stages

U.S. Pat. No. 5,648,008, issued to Barritt et al., the contents of all of which are incorporated herein by reference in their entirety, discloses an induction cooktop with a particular analog/digital control circuit. Baritt does not appear to disclose a unit allowing a user to program multiple cooking stages. U.S. Pat. Nos. 4,169,222; 4,308,433; and 4,511,781, issued to Tucker et al., the contents of all of which are incorporated herein by reference in their entirety, disclose an induction cooktop range with a touch pad coupled to a touch input circuit further coupled to a microprocessor used to operate the components of the unit. In one exemplary embodiment, one or more microprocessor may be employed, in other exemplary embodiments, a microcontroller, a processor, a field programmable gate array (FPGA), an application specific integrated circuit (ASIC), or other hardware, software, middleware, etc. system may be employed. The user may use the touch pad (HI/LOW) to specify a power level in increments of ten up to 100. The conventional cooktops fail to provide for multiple cooking stages, according to an exemplary embodiment of the present invention.

B. Precise Temperature Adjustment

An example of conventional induction cooktops may include: U.S. Pat. Nos. 5,648,008, 4,536,631 and 4,556,770, the contents of all of which are incorporated herein by reference in their entirety. The '008 patent appears to disclose an induction cooker with an analog/digital control circuit that includes a temperature select control coupled to a programmed microprocessor. The temperature select control receives user input via a potentiometer, and a temperature level selector is coupled between the temperature select control and the microprocessor. The microprocessor provides signals to start and stop operation of the unit to achieve a desired cooking temperature. However, the conventional induction cooktops fail to enable a user to precisely specify a set temperature for a counter-top induction cooker in 10 degree F. increments in response to actuation of input buttons on a control panel.

Cooking Modes

The improved induction cooktop may include a new way to specify cooking modes. Conventional induction cooktops often present various power levels—for example, power levels 1 through 6—as cooking options. A symbol may then be associated with each power level identifying the types of cooking that may be achieved with a particular level. For example, a symbol for boiling water may be associated with power level 5 in a conventional induction cooktop. The improved induction cooktop may provide more intuitive cooking modes enabling a user to select from: low; medium-low; medium; medium-high; high; and sear, etc., according to an exemplary embodiment. According to an exemplary embodiment, a cooking device may be adapted to receive a programmable recipe. According to one exemplary embodiment, the cooking system may be coupled to a memory device, such as, e.g., but not limited to, a universal serial bus interface to allow importing recipes into the exemplary cooking system. According to exemplary embodiments, one or more recipes may be stored on at least one memory such as, e.g., but not limited to, a SDRAM, DRAM, removable, or non-removable, etc. According to one exemplary embodiment, any of various well know ARM standard architecture Processors systems on a chip (SOC), available from ARM Ltd. of UK, may be integrated into various exemplary, but non-limiting embodiments. According to one exemplary embodiment, the cooking system may be coupled to a network to receive an electronic recipe which may be distributed over an electronic network such as, e.g., but not limited to, an internet, a global Internet, a wireless network, a WIFI network, a WIMAX network, etc.

Programmable Cooking Stages

The improved induction cooktop also may include the ability to program the unit to carry out desired cooking stages. The unit may include a controller, which may have embedded software that may enable a user to specify up to three different cooking stages. Each cooking stage may be defined by a temperature and a time—up to 99 hours and 99 minutes—which the user selects using the control panel of the unit, according to an exemplary embodiment. The controller then may carry out each stage by automatically adjusting the temperature at the beginning of each stage, according to an exemplary embodiment.

Precise Temperature Adjustment

The improved induction cooktop additionally may include the ability to precisely specify a desired temperature, according to an exemplary embodiment. The improved cooktop may enable a user to specify precise temperatures in increments of 10° F., according to an exemplary embodiment. According to various other exemplary embodiments, any of various other temperature increments may be used. The user may operate button(s) on the control panel/interface so as to make selections to increase or decrease the temperature, according to an exemplary embodiment.

Low Temperature Cooking

The improved induction cooktop also may feature the ability to cook at temperatures conventional induction cooktops may not be able to achieve, according to an exemplary embodiment. The improved cooktop is able to achieve temperatures as low as 100° F., according to an exemplary embodiment. According to various other exemplary embodiments, any of various other low temperature operating modes as may be useful for cooking applications may be used. According to various other exemplary embodiments, various high temperature cooking features may also be provided. According to one exemplary embodiment, a searing programmable mode may, in an exemplary embodiment, initially heat at a high level, for an exemplary set period of time, and may then change to a second temperature level after completion of the exemplary set period of time. In one exemplary embodiment, the searing time period may be set at up to a limited default maximum time period, to avoid safety issues, and may be prevented from allowing user increase of that time. In other exemplary embodiments temperatures and times of operation may be user selectable.

Safety Mechanism

The improved induction cooktop may include a novel safety mechanism to permanently disable defective cooktop units, according to an exemplary embodiment. To prevent exceedingly high and potentially dangerous temperatures, the improved cooktop may include a thermal fuse that may permanently disable the device if the unit reaches an abnormally high temperature, such as, e.g., but not limited to, upwards of 570° F., according to an exemplary embodiment. Such abnormally high temperatures may be an indication of a defective unit; thus, the unit may be designed to disable itself permanently, according to an exemplary embodiment.

Extended Glass Surface

The improved induction cooktop may include a ceramic glass surface that extends to the edge of the unit. The extended surface may reduce the danger of liquid entering the interior of the unit from the surface. Instead, any spilled liquid either remain safely on the surface or drip down the side walls of the unit to the countertop.

Side Wall Ridge

The improved induction cooktop also may include a ridge on the side wall of the unit to further prevent liquid from entering the unit. The unit may include air vents positioned in the side wall. According to one exemplary embodiment side air vents in the side wall may be a plurality of holes, vertical slits, ellipses, etc. to allow cooling of electronics of the exemplary induction cooking unit. If liquid spills off the surface and travels down the side wall of the unit, there is a danger this liquid will enter the unit through the air vents and damage interior components. The addition of a ridge to the side wall of the unit may extend the upper portion of the side wall over and away from the air vents positioned in the lower portion of the side wall. Thus, any liquid traveling down the side wall may drop from the ridge to the countertop reducing the danger of liquid entering the unit. According to an exemplary embodiment a single range element is shown and described. In another exemplary embodiment, a plurality of induction cooking units may be provided.

Angled and Arched Control Panel

The improved induction cooktop further may include an angled and arched control panel, according to an exemplary embodiment. Conventional induction cooktops often include a control panel that extends straight out from the base with the face of the control panel facing straight upward. A user may have trouble seeing all of the buttons and labels on these upward-facing, flat control panels unless the user stands directly over the panel, according to an exemplary embodiment. Additionally, users may have difficulty reading labels and pressing buttons when viewing these panels at an angle, according to an exemplary embodiment.

The control panel of the improved cooktop may extend away from the unit at a downward angle to present an angled and more readable control panel, according to one exemplary embodiment. Further, instead of a flat-faced control panel, the improved cooktop may add an arch shape to the face of the control panel to improve usability, according to one exemplary embodiment.

An exemplary counter-top electric induction cooktop is described herein with reference to the accompanying drawings in accordance to an exemplary embodiment of the invention. However, it should be understood that many features of the invention may find utility in other types of counter-top electric cooking apparatuses, devices and systems. Accordingly, no limitation is intended with respect to the type of heating device, or accessories, except insofar as expressly stated in the appended claims.

In an exemplary embodiment, the induction cooking device may include, in an exemplary embodiment, a control system, which may be electronically coupled to the induction cooking device and its interface allowing for exemplary programmed control of the induction cooking device. The cooking device may include various electronic components in an exemplary embodiment, including, e.g., but not limited to, any combination of, an oscillating magnetic field creating circuit, a control circuit or system, a controller, a microcontroller, a microprocessor, an FPGA, an ASIC, a thermostat, a thermistor, a coil, a memory, a sensor, a power supply, a cord for coupling the device to a power source, a cooking surface, and induction cooking electronic element, a fan, etc.

According to an exemplary embodiment, the control system may be configured to selectively power the induction field creating element at a number of power levels P from a minimum power to a maximum power to induce an oscillating magnetic field in any of various exemplary magnetic cookware accessories, according to an exemplary embodiment.

At each power increment P, the control system may power the induction heating element(s) depending on a level or increment of the power level selected on the cooktop's interface. The control system may terminate power to the induction cooking element if a condition is sensed that a sensed temperature indicated by a thermistor exceeds a high temperature threshold associated with a particular power level P. The control system may provide power continuously to one or more of a cooling fan designed to cool the induction cooktop's electronics during the heating operations regardless of the power level selected. According to one exemplary embodiment, a multi-stage cooking recipe may be input, processed, stored, accessed, executed and/or deleted by the control system.

According to an exemplary embodiment, the control system may power the induction cooktop to heat an associated exemplary accessory, e.g., but not limited to cooking device, or pot such as, e.g., but not limited to the accessories set forth in the exemplary embodiments of the present invention, among others, etc.

According to an exemplary embodiment, various cooking modes may be provided.

The control system may support one or more power levels. Each power level may represent a target temperature to heat the cooktop's associated accessory. In an exemplary embodiment, the control system may have, e.g., but not limited to, ten or more different selectable power levels. In an exemplary embodiment, the power levels may correspond to temperature levels such as, e.g., but not limited to, low, medium low, medium, medium high, high, sear, etc., however alternative indications for cooking modes may be provided.

According to another exemplary embodiment, various programmable cooking stages may be provided.

In an exemplary embodiment, a plurality of cooking stages may be programmed to include both a heating level indication and a period of time desired to be cooked at a given stage's heating level, according to an exemplary embodiment.

According to another exemplary embodiment, precise temperature and precise time adjustment may be provided. In an exemplary embodiment, the device may allow for very fine granularity temperature adjustment of, e.g., but not limited to, 10 degrees Fahrenheit increments, such as, e.g., but not limited to, the temperatures 100° F., 110° F., 120° F., 130° F., 140° F., . . . , 210° F., 220° F., 230° F., 240° F., . . . etc., 320° F., and/or 330° F., etc.

According to an exemplary embodiment, low temperatures as low as, e.g., but not limited to, 100° F., etc., may be achieved.

In an exemplary embodiment, the oven may be designed to allow vegans and vegetarians to cook the food to the point where the bacteria are eliminated but, at the same time, not eliminate vital enzymes in the food. For example, the oven may preserve vital enzymes in vegetables by controlling the temperature of the oven. In one such exemplary embodiment, a power level of the oven may set the desired temperature of the oven to be, e.g., but not limited to, 106° F., though additional power levels of the oven may be configured to control the temperature of the oven for eliminating bacteria and preserving vital enzymes in food. In an exemplary embodiment, the power levels may correspond to several temperatures such as, e.g., but not limited to, the following temperatures: 106° F., 116° F., 150° F., 175° F., 225° F., 250° F., 275° F., 300° F., 325° F., and/or 350° F., etc.

An exemplary embodiment of the control system may also include, in an exemplary, but non-limiting environment, a processor, and a storage device, such as, e.g., but not limited to, a memory, a register, a read-only memory (ROM), a random access memory (RAM), a solid state memory device, a flash memory device, a hard disk drive (HDD), a removable disk device such as, e.g., but not limited to, a CD-ROM, a DVD, etc. According to an exemplary embodiment, command signal input from the input interface (such as, e.g., but not limited to, a keyboard, a keypad, a remote control, a voice activated interface, a voice recognition system, etc.) by a user may be received by a sensor and provided, e.g., to the processor and storage device to create a multi-stage cooking recipe that may be further edited or executed. In an exemplary embodiment the multi-stage cooking recipe may be stored in the storage device n the form of volatile memory for temporary storage, nonvolatile memory for permanent storage, or both. During execution the processor may receive input from a variety of sources to determine what and when stages should be executed.

In the exemplary embodiments, the cooktop apparatus may include, e.g., but not limited to, metal and/or glass components such that the oven can sustain a higher maximum temperature than an oven composed of polycarbonate can sustain. According to an exemplary embodiment, the oven may include a digital interface, as shown in various exemplary figures, and/or an analog interface. According to an exemplary embodiment the cooktop may include a top view which may be, e.g., but not limited to, a circular shape, an oval shape, or any number of other shapes such as, e.g., but not limited to, triangular, square, rectangular, trapezoidal, octagonal, polygonal, pentagonal and/or hexagonal, etc.

In another exemplary embodiment, an exemplary input interface of an exemplary embodiment of a multi-stage cooktop. The input interface may include, e.g., but not limited to, a numeric keypad by which numerical values can be inputted into the oven for values such as, e.g., but not limited to, the power level, time duration of cooking, desired temperature, level of doneness, memory address, etc. Alternatively, voice recognition and/or other input interface may be included. The input interface may also include control elements corresponding to various stages of a recipe including, e.g., but not limited to, a delay stage, a sear stage, and/or a warm stage, etc. The input interface may also include control elements for programming information for each stage including, e.g., but not limited to, power level, cook time, etc. The input interface may also include control elements for commands such as, e.g., but not limited to, pause, clear, reheat, start, etc. The input interface may also include control elements for programming functions such as, e.g., but not limited to, program input, memory, recall, etc.

An exemplary display panel of an exemplary embodiment of a multi-stage cooking electric cooktop is illustrated in FIG. 1B. The exemplary display panel may display multi-stage cooking recipe information such as, e.g. but not limited to, time, power level, and/or stage, etc. The exemplary display panel, in an exemplary embodiment may include an area in which a numerical value can be displayed, in the exemplary embodiment, comprising of four seven-segment displays. The numerical value can represent information regarding, e.g., but not limited to, the duration time, duration of time left, memory address to save and/or load a multi-stage cooking recipe, etc. The exemplary display panel may also include, e.g., but not limited to, a display in which the power level of a stage can be displayed. Another display, in the exemplary embodiment may show the stage number. The exemplary display panel may also, or instead include, e.g., but not limited to, indicators for each type of stage or type of programming information needed. In the exemplary embodiment, the indicators may include, e.g., but not limited to, POWER, PROG, DELAY, MIN, STAGE, SEAR, COOK and/or WARM, etc. In an exemplary embodiment, these indicators may blink when their corresponding information may be entered and may remain lit after their corresponding information is set. According to an exemplary embodiment, during execution these indicators may light up to indicate which stage is being executed and which stages may remain.

An exemplary process flowchart of a basic multi-stage cooking recipe algorithm executable by an exemplary control system of an exemplary counter-top oven, according to an exemplary embodiment of the invention may include various exemplary steps. According to an exemplary embodiment, the process flowchart may begin and may continue with receiving cooking programming input for a multi-stage cooking recipe from the input interface. After receiving an indication that the start button is depressed, any programmed delay stage may be performed, e.g., according to an exemplary embodiment. During the delay stage the cooktop may wait for the corresponding programmed duration before beginning cooking in the following stages. At the end of the delay stage the cooktop may beep to signal the end of the stage. After the delay stage, any sear stage may be performed, according to an exemplary embodiment. The sear stage may heat the cooking accessory to a high temperature to sear the food initially for better browning and locking in juices. At the end of the sear stage the oven may beep to signal the end of the stage. Instead of, or after, the sear stage any other user-defined cooking stages may also be performed. In an exemplary embodiment, there may be multiple user-defined cooking stages, e.g., but not limited to, two, three, four, five, six, etc., cooking stages. In an exemplary embodiment, the initial user-defined cooking stage may be performed by heating the cooktop according to a specified power level for a duration corresponding to factors such as, e.g., but not limited to, duration of time, desired temperature, level of doneness, etc. After the initial cooking stage, if any user-defined stages remain, each subsequent cooking stage may be sequentially performed. After all cooking stages are completed, the cooktop may signal, such as, e.g., beep four times and then may perform a warm stage, if any. During the warm stage, the cooktop may, e.g., heat the food at a low temperature to keep the food warm while it is in the cooktop. The process flowchart may then end, according to an exemplary embodiment.

A more detailed exemplary process of receiving cooking program input is described in greater detail, according to an exemplary embodiment of the invention. In an exemplary embodiment, the process may begin at program input stage. In an exemplary embodiment, the program input may occur when the control system may receive a Memory/Recall input request, and/or receive a Program Input request. When a Memory/Recall input request is received, the control system may, e.g., display "PROG" and '0' on the LCD, and may wait to receive a valid memory number, according to an exemplary embodiment of the invention. Upon receiving a memory number, the control system may then load the previously programmed user-entered multi-stage cooking recipe from the corresponding memory address, according to an exemplary embodiment of the invention.

According to an exemplary embodiment, after a program loads, and/or a Program Input request is received, the control system may display "PROG" on the LCD, according to an exemplary embodiment of the invention. The control system may then wait for further user input, according to an exemplary embodiment of the invention. If the system receives a Delay input request, it may receive the Delay input parameters, according to an exemplary embodiment of the invention. If the system receives a Sear input request, it may receive the Sear input parameters, according to an exemplary embodiment of the invention. If the system receives a Warm input request, it may receive the Warm input parameters, according to an exemplary embodiment of the invention. If the system receives a Cooking Stage input request, it may receive the Cooking Stage input parameters, according to an exemplary embodiment of the invention. If the system receives a Memory/Recall input request, it may display "PROG" and '0' on the LCD, according to an exemplary embodiment of the invention. After the control system receives the memory number and the program set request, it may save the current cooking recipe to the corresponding memory address, according to an exemplary embodiment of the invention. In the case where the corresponding memory address already has a previously saved cooking recipe, the previously programmed recipe may be overwritten with the current recipe, according to an exemplary embodiment of the invention. After receiving the input in each of the above cases, the control system may then return to display "PROG" on the LCD, and may wait for further user input, according to an exemplary embodiment of the invention. When the control system receives a Start request, program input may end, and the control system may begin execution of the recipe, according to an exemplary embodiment of the invention. In an, exemplary embodiment additional programming such as, e.g., but not limited to, editing, adding and/or deleting stages may occur even during execution of the recipe.

According to another exemplary process flow a Delay input parameter may be received is described in further detail. In an exemplary embodiment, when an input request is received, Delay input parameters may be received, according to an exemplary embodiment of the invention. In an exemplary embodiment, the process flow may start and may continue, in response to the input request, to blink DELAY and MIN on the LCD and/or display the current time duration value of the delay, according to an exemplary embodiment of the invention. If there is no current value, the default value may be 00:00, according to an exemplary embodiment of the invention. Upon the control system receiving the time input parameters from user input, MIN may stop blinking, but DELAY may continue to blink, according to an exemplary embodiment of the invention. After receiving the Program Set input, DELAY may stop blinking and/or may remain on, according to an exemplary embodiment of the invention. From there, the process flow may then end, according to an exemplary embodiment of the invention.

According to another exemplary process flow a Sear input parameter may be received, according to an exemplary embodiment of the invention. In an exemplary embodiment, when a Sear input request is received, Sear input parameters may be received, according to an exemplary embodiment of the invention. In an exemplary embodiment, the process flow may start at and may continue, in response to the input request, to blink SEAR and MIN on the LCD and/or display the current time duration value of the sear, according to an exemplary embodiment of the invention. If there is no current value, the default value may be 00:05, according to an exemplary embodiment of the invention. Upon the control system receiving the time input parameters from user input, MIN may stop blinking, but SEAR may continue to blink, according to an exemplary embodiment of the invention. After receiving the Program Set input, SEAR may stop blinking and may remain on, according to an exemplary embodiment of the invention. From there, the process flow may then end, according to an exemplary embodiment of the invention.

According to another exemplary process flow a Warm input parameter may be received, according to an exemplary embodiment of the invention. In an exemplary embodiment, when a Warm input request is received, according to an exemplary embodiment of the invention, Warm input parameters may be received. In an exemplary embodiment, the process flow may start and may continue, in response to the input request, to blink WARM and MIN on the LCD and/or display the current time duration value of the warm, according to an exemplary embodiment of the invention. If there is no current value, the default value may be 02:00, according to an exemplary embodiment of the invention. Upon the control system receiving the time input parameters from user input, MIN may stop blinking, but WARM may continue to blink, according to an exemplary embodiment of the invention. After receiving the Program Set input, WARM may stop blinking and may remain on, according to an exemplary embodiment of the invention. From there, the process flow may then end, according to an exemplary embodiment of the invention.

According to an exemplary embodiment, a process flow of receiving Cooking stages after receipt of a Cooking State input request is described in further detail, according to an exemplary embodiment of the invention. In an exemplary embodiment, cooking stages may be received after a Cooking Stage input request has been received, according to an exemplary embodiment of the invention. In an exemplary embodiment, the process flow of cooking stages may begin and may continue with blinking COOK on the LCD, according to an exemplary embodiment of the invention. The control system may then display the current stage number, power level for the stage and time duration of the stage, according to an exemplary embodiment of the invention. If there are no current values for any of the above elements, the default values of Stage '1', "HI" power, and "00:00" min may be used, respectively, according to an exemplary embodiment of the invention. The control system may then wait for further user input. The system may then wait for a Cook Time input request, a Power Level input request, a Stage Cook input request, and/or a Program Set input, according to an exemplary embodiment of the invention.

If a Cook Time input request is received, the system may blink MIN, according to an exemplary embodiment of the invention. Upon receiving the Cook Time input parameters from user input for the Cooking Stage, MIN may stop blinking, according to an exemplary embodiment of the invention.

If a Power Level input request is received, the system may blink the Power Level display box, according to an exemplary embodiment of the invention. Upon receiving the Power Level input parameters from user input for the Cooking Stage, the Power Level display box may stop blinking, according to an exemplary embodiment of the invention.

If a Stage Cook input request is received, the system may check whether the current stage has a non-zero Cook Time duration value, according to an exemplary embodiment of the invention. If the duration value is non-zero, then the system may check whether the current stage is the last defined stage and that the maximum number of stages has not been reached, according to an exemplary embodiment of the invention. If the current stage is the last defined stage and is not the maximum stage allowed, the system may create a new subsequent stage and proceed to that stage, displaying and assigning values as previously described for, according to an exemplary embodiment of the invention. If the current stage is not the last defined stage and/or the current stage is the maximum stage allowed, the system may proceed to the subsequent existing stage, according to an exemplary embodiment of the invention. In the case where the current stage is not the last defined stage, the subsequent existing stage may be the next numerical stage. In the case where the current stage is the maximum stage allowed, the subsequent existing stage may be the first stage, Stage 1. If the current stage cooktime is not non-zero, the current stage may be cancelled, according to an exemplary embodiment of the invention, which may require the system to automatically renumber any subsequent stages, and the system may proceed to the subsequent existing stage. In the case where the current cancelled stage was the last stage, the subsequent existing stage may be the first stage, otherwise, the subsequent existing stage may be the following stage. If the program set request is received, the system may stop blinking COOK and leave COOK lit, and may end receiving cooking stage input, according to an exemplary embodiment of the invention. The process may then end, according to an exemplary embodiment of the invention.

In an exemplary embodiment, the oven may accept commands for actions such as, e.g., but not limited to, pause, start, clear, display sensor data, and/or reheat, etc., according to an exemplary embodiment of the invention. An exemplary pause command may suspend execution of the recipe, according to an exemplary embodiment of the invention. An exemplary start command may unpause execution, according to an exemplary embodiment of the invention. An exemplary clear command may clear current programming information being entered, according to an exemplary embodiment of the invention. An exemplary display sensor data command may display on the interface, sensor information, such as, e.g., but not limited to, temperature and/or level of doneness, etc., according to an exemplary embodiment of the invention. An exemplary reheat command may set the power level to "HI" for 4 minutes, according to an exemplary embodiment of the invention. According to an exemplary embodiment, commands may be received and executed during the multi-stage cooking recipe programming and/or during execution of a multi-stage cooking recipe.

Compatible Cookware and Accessories

Types of Pans to Use on an Induction Cooktop:

Since induction is based on magnetic principles, the cookware used on it must have a ferrous (iron-based, magnetic) bottom. Some types of cookware are made of naturally magnetic metals (such as pure iron), while others are made to be magnetic by "sandwiching" a thin layer of a ferrous metal in the base. This layer in the base will be affected by the magnetic field of the induction cooktop and distribute the heat. Tri-ply, high-quality stainless steel and cast iron cookware will work on induction cooktops. Copper, glass and aluminum cookware will not work unless they have a sandwiched magnetic base. The pots that work best on induction cooktops are medium to heavy gauge.

Attention:

The cookware used on a Precision Induction Cooktop, according to an exemplary embodiment, should not exceed 9 inches in diameter. On the heating surface, the 9 inches in diameter is indicated within the larger red ring, see FIG. 1I.

Examples of compatible cookware:

All Precision Cookware

Enameled iron and steel

Stainless steel with a magnetic base

Cast iron

Examples of Non-induction compatible cookware:

Copper

Glass

Aluminum

Pottery type vessels

How to check your cookware for Induction Compatibility? There are three simple ways to check if your existing cookware or future cookware purchases can be used on the Precision™ Induction Cooktop:

1) An induction symbol resembling a series of loops may be printed on the bottom of the cookware.

2) A small amount of water may be placed in an inductive pot or pan. When placed on an induction appliance, water may start to boil.

3) A magnet is typically another great indicator of compatible cookware. The magnet may stick to the bottom of the cookware, which usually means it is induction ready, however, sometimes the magnetic property in the cookware will not be strong enough for the pot to work efficiently.

Depictions of various exemplary cookware and accessories as may be used with exemplary embodiments of the claimed invention are included in various accompanying figures.

Exemplary Embodiment of Computer Environment

An exemplary computer system that may be used in implementing an exemplary embodiment of the present invention. Specifically, the controller may include in an exemplary embodiment, a computer system that may be used in computing devices such as, e.g., but not limited to, client or server, etc. according to an exemplary embodiment of the present invention. An exemplary embodiment of a computer system that may be used as a client device or a server device in an apparatus or system, etc. The present invention (or any part(s) or function(s) thereof) may be implemented using hardware, software, firmware, or a combination thereof and may be implemented in one or more computer systems or other processing systems. In fact, in one exemplary embodiment, the invention may be directed toward one or more computer systems capable of carrying out the functionality described herein. An example of a computer system in an exemplary embodiment may include a block diagram of an exemplary computer system useful for implementing the present invention. Specifically, an example computer, which in an exemplary embodiment may be, e.g., (but not limited to) a personal computer (PC) system running an operating system such as, e.g., (but not limited to) MICROSOFT® WINDOWS® NT/98/2000/XP/CE/ME/ etc. available from MICROSOFT® Corporation of Redmond, Wash., U.S.A., MACH derived operating systems, MAC OSX, and iOS available from Apple Inc. of Cupertino, Calif., U.S.A., UNIX, or Android available from Google Inc. of Mountain View, Calif., U.S.A. However, the invention may not be limited to these platforms. Instead, the invention may be implemented on any appropriate computer system running any appropriate operating system. In one exemplary embodiment, the present invention may be implemented on a computer system operating as discussed herein. An exemplary computer system, may include any of various components of exemplary embodiments of the invention, such as, e.g., (but not limited to) a computing device, a communications device, a mobile phone, a tablet device, a telephony device, a telephone, a personal digital assistant (PDA), a personal computer (PC), a handheld PC, an interactive television (iTV), a digital video recorder (DVD), an iPhone, an iPad, an Android device, a Microsoft Phone, client workstations, thin clients, thick clients, proxy servers, network communication servers, remote access devices, client computers, server computers, routers, web servers, peer-to-peer devices, data, media, audio, video, telephony or streaming technology servers, etc., may also be implemented using a computer.

The computer system may include one or more processors, such as, e.g., but not limited to, processor(s). The processor(s) may be connected or coupled to a communication infrastructure (e.g., but not limited to, a communications bus, cross-over bar, or network, etc.). Various exemplary software embodiments may be described in terms of this exemplary computer system. After reading this description, it may become apparent to a person skilled in the relevant art(s) how to implement the invention using other computer systems and/or architectures.

The computer system may include a display interface that may forward, e.g., but not limited to, graphics, text, and other data, etc., from the communication infrastructure (or from a frame buffer, etc., not shown) for display on the display unit.

The computer system may also include, e.g., but may not be limited to, a main memory, random access memory (RAM), and a secondary memory, etc. The secondary memory may include, for example, (but not limited to) a hard disk drive and/or a removable storage drive, representing a floppy diskette drive, a magnetic tape drive, an optical disk drive, a compact disk drive CD-ROM, a digital versatile disk (DVD), a flash memory device, or solid state memory card or device, etc. The removable storage drive may, e.g., but not limited to, read from and/or write to a removable storage unit in a well known manner. Removable storage unit, also called a program storage device or a computer program product, may represent, e.g., but not limited to, a floppy disk, magnetic tape, optical disk, compact disk, etc. which may be read from and written to by removable storage drive. As may be appreciated, the removable storage unit may include a computer usable storage medium having stored therein computer software and/or data.

In alternative exemplary embodiments, secondary memory may include other similar devices for allowing computer programs or other instructions to be loaded into computer system. Such devices may include, for example, a removable storage unit and an interface. Examples of such may include a program cartridge and cartridge interface (such as, e.g., but not limited to, those found in video game devices), a removable memory chip (such as, e.g., but not limited to, an erasable programmable read only memory (EPROM), or programmable read only memory (PROM) and associated socket, and other removable storage units and interfaces, which may allow software and data to be transferred from the removable storage unit to computer system.

Computer may also include an input device such as, e.g., (but not limited to) a mouse or other pointing device such as a digitizer, and a keyboard or other data entry device (none of which are labeled).

Computer may also include output devices, such as, e.g., (but not limited to) display, and display interface. Computer may include input/output (I/O) devices such as, e.g., (but not limited to) communications interface, cable and communications path, etc. These devices may include, e.g., but not limited to, a network interface card, and modems (neither are labeled). Communications interface may allow software and data to be transferred between computer system and external devices.

In this document, the terms "computer program medium" and "computer readable medium" may be used to generally refer to media such as, e.g., but not limited to removable storage drive, a hard disk installed in hard disk drive, and signals, etc. These computer program products may provide software to computer system. The invention may be directed to such computer program products.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic.

Further, repeated use of the phrase "in one embodiment," or "in an exemplary embodiment," do not necessarily refer to the same embodiment, although they may.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Unless specifically stated otherwise, as apparent from the following discussions, it is appreciated that throughout the specification discussions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In a similar manner, the term "processor" may refer to any device or portion of a device that processes electronic data from registers and/or memory to transform that electronic data into other electronic data that may be stored in registers and/or memory. A "computing platform" may comprise one or more processors.

Embodiments of the present invention may include apparatuses for performing the operations herein. An apparatus may be specially constructed for the desired purposes, or it may comprise a general purpose device selectively activated or reconfigured by a program stored in the device.

In yet another exemplary embodiment, the invention may be implemented using a combination of any of, e.g., but not limited to, hardware, firmware and software, etc.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. A countertop induction cooking system, comprising:

a circular induction cooking unit comprising:

i. a heat-resistant top surface extending to an edge of the induction unit and configured to receive induction cookware thereupon, ii. an induction electromagnetic coil located below the heat-resistant top surface, iii. a fan, and iv. a vent;

a system housing supporting the heat-resistant top surface at a periphery and enclosing the induction electromagnetic coil of the circular induction cooking unit;

an interface coupled to the circular induction cooking unit and retained within the system housing, the interface comprising:

i. an input panel having a plurality of input buttons which allow a user to create a multistage programmable recipe, the input buttons including at least one of either a temperature or a time input button, using induction cooking, to generate a user selected direct command, ii. memory to store the user selected direct command, and iii. an input button which begins execution of the stored user selected direct command when pushed;

a power supply configured to couple the at least one induction electromagnetic coil of the circular induction cooking unit to an external power source; and an electronic controller positioned within the system housing and comprising a processor coupled to the power supply, the interface, the fan, and the induction electromagnetic coil of the circular induction cooking unit;

wherein the controller is configured to control the at least one induction electromagnetic coil of the circular induction cooking unit according to the stored user selected direct command when executed.

2. The countertop induction cooking system of claim 1, wherein the plurality of input buttons comprises non-numeric buttons configured to create the user selected direct command.

3. The countertop induction cooking system of claim 2, wherein the plurality of non-numeric buttons comprises:

a program button configure to receive a user selected direct command;

a temperature level button;

an increase time or temperature button;

a decrease time or temperature button;

a start program button; and a cancel program button.

4. The countertop induction cooking system of claim 2, wherein each of the plurality of non-numeric buttons is associated with a given temperature range for heating the induction cooking unit.

5. The countertop induction cooking system of claim 1, wherein said interface comprises an alphanumeric display adapted to output an alphanumeric indication of at least one of a temperature, a time, and a program stage.

6. The countertop induction cooking system of claim 1, wherein the induction cooking unit is configured to operate at a temperature as low as about 100 degrees Fahrenheit.

7. The countertop induction cooking system of claim 1, further comprising a temperature sensor coupled to the electronic controller, wherein the controller is configured to disable operation of the induction cooking unit when temperature exceeding an abnormally high threshold is sensed by the temperature sensor.

8. The countertop induction cooking system of claim 7, wherein said abnormally high threshold is about 570 degrees Fahrenheit.

* * * * *